US005417597A

United States Patent [19]

Levedahl

[11] Patent Number: 5,417,597

[45] Date of Patent: May 23, 1995

[54] VESSEL WITH MACHINERY MODULES OUTSIDE WATERTIGHT HULL

[75] Inventor: William J. Levedahl, Annapolis, Md.

[73] Assignee: The United States of America as represented by the Secretary of the Navy, Washington, D.C.

[21] Appl. No.: 234,768

[22] Filed: Apr. 28, 1994

[51] Int. Cl.[6] ..... B63B 3/00

[52] U.S. Cl. ..... 440/6; 114/65 R

[58] Field of Search ..... 114/258, 259, 260, 261, 114/264, 56, 65 R, 57; 440/6, 49, 53

[56] References Cited

U.S. PATENT DOCUMENTS

| | | | |
|---|---|---|---|
| 3,842,782 | 10/1974 | Cuttica | 114/260 |
| 4,308,815 | 1/1982 | Conway | 114/65 R |
| 4,476,797 | 10/1984 | Ivanov et al. | 114/65 R |

OTHER PUBLICATIONS

Levedahl, William J., Samual R. Shank and William P. O'Reagan, "DD21A-A Capable, Affordable, Modular 21st Century Destroyer," Carderock Division Naval Surface Warfare Center report CARDINVSWC--TR-93/013 (Dec. 1993).

Levedahl, William J., "A Capable Affordable 21st--Century Destroyer," Naval Engineers Journal, vol. 105, No. 3 (May 1993), pp. 213-223.

Levedahl, William J., "Intergrated Ship Machinery Systems Revisited," Naval Engineers Journal, vol. 101, No. 3, (May 1989), pp. 93-101.

Levedahl, William J., "Integrated Ship Machinery Systems Which Result in Small, Efficient Destroyers," Naval Engineers Journal, vol. 92, No. 2 (Apr. 1980), pp. 271-278.

*Primary Examiner*—Stephen P. Avila

*Attorney, Agent, or Firm*—Gary G. Borda

[57] ABSTRACT

The invention is directed to an improved vessel configuration for high speed ships such as Naval Destroyers. The vessel has a long, slender tumble home (inward-sloped topsides) watertight hull and a deckhouse structurally integral with the watertight hull. All main machinery is modular and outside the watertight hull, freeing midship areas for personnel. Two removable, prealigned and pretested, steerable propulsor modules are attached to the stern after construction and are replaceable pierside. Each propulsor module includes a steerable pod aligned to the water inflow, a steering cylinder, and a streamlined strut connecting the pod to the steering cylinder. Two removable, power modules are mounted above the weather deck in a deckhouse. Each power module includes an intercooled, recuperated gas turbine, ship-service alternator, and a propulsion alternator. The present vessel provides global range, reduced lightship displacement, reduced cost, superior seakeeping, no seawater ballast, sharper turns and stops, and greatly reduced installed power, fuel consumption, and pollution.

23 Claims, 13 Drawing Sheets

VESSEL WITH MACHINERY MODULES OUTSIDE WATERTIGHT HULL

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of Invention

The present invention relates generally to an improved vessel configuration for high speed ships such as Naval Destroyers and, more particularly, to a vessel having a watertight hull with no penetrations therein for propulsion machinery wherein all main machinery is modular and is located outside the watertight hull.

2. Brief Description of Related Art

Ever since steam powered propellers replaced wind powered sails as the main means of propelling ships, the powerplant has occupied the center of the hull. The midship located powerplant has been connected by long, heavy shafts to aft mounted propellers. Steering has generally been provided by rudders aft of the propellers. From the middle of the nineteenth century to the present the overwhelming proportion of the world's surface combatants and cargo ships have shared this configuration.

The Great White Fleet of Teddy Roosevelt's era, the four stacked destroyers of World War I, and the entire World War II fleet are examples of such designs. Nuclear powerplants introduced into Naval cruisers and destroyers merely substituted for the boilers, fuel tanks, and turbines of their fossil-fueled predecessors.

When compact, aircraft-derivative gas turbines were introduced in the Spruance class destroyers in the seventies, the powerplant configuration was little changed from those preceding it. The Ticonderoga class cruisers of the eighties and the Arleigh Burke class destroyers of the nineties retain this same powerplant configuration. For surface combatants with maximum Froude Numbers exceeding 0.4, this configuration can cause the cost of the mechanical and electrical systems to exceed four times the cost of the hull structure.

For high speed ships, wavemaking resistance increases dramatically with speed. Resistance of a bare-hull can be divided into a viscous component and a wavemaking component. For ships at low speeds, viscous resistance predominates, whereas at sustained speed (speed at 80% of full power) and maximum speed (speed at full power), large wavemaking resistance is added. Wavemaking resistance is somewhat dependent on hull shape, heavily dependent on "fatness," and varies sharply with the dimensionless Froude Number [$Fr=V/(gL)^{0.5}$, where V is ship speed, g is the gravitational constant, and L is length at the waterline]. Wavemaking resistance is very small compared to viscous resistance at Froude numbers below about 0.34, but then it rises sharply so that at a Froude number of about 0.45, its value is several times that of viscous resistance. Furthermore, the open shafting of high speed Naval combatants typically adds 45% to the viscous resistance of the bare hull.

For displacement monohulls, to minimize the cost of the power systems, the hull should be long enough that the sustained speed is reached without wavemaking resistance becoming predominant. Preferably, the Froude number should not exceed 0.38 at sustained speed. In the past, the Navy design philosophy was that propulsion systems were preordained, of fixed cost and size, and that ship cost was best reduced by making the ship as short as possible. The 466 foot length Arleigh Burke class "short" destroyer represents the philosophy of trying to save cost by shortening the hull. However, shortening the hull increases Froude number, and thus wavemaking resistance, at a given speed. Increased resistance translates to increased power required for a given speed which, in turn, increases the fuel consumption over time. In addition, at a constant fuel capacity, ship resistance is approximately inversely proportional to ship range.

A conventional, prior art ship design having vertical topsides 10 is depicted in FIGS. 1–4. Centrally located powerplants 12 and propulsion shafting 14 are installed in the hull early in the overall ship construction process. As shown in FIGS. 3 and 4, powerplants 12 are generally located in one or more large main machinery rooms 16 that, along with required air intake ducting 18 and exhaust ducting 20, occupy a large volume near midships. It is prohibitively costly to remove and replace much of the main machinery systems once installed. Removing propulsion power generation machinery 22, propulsion transmission machinery (shafting 14 and gears 24), or ship-service electrical generation machinery 26 and 28 would require cutting large holes in the side of the hull. Consequently, these machinery systems are designed to have very low stresses and are thus exceedingly heavy and costly. Lightly loaded "safe" gears are a high weight legacy of this configuration. A second legacy is long, heavy shafting, which is costly to align. A third legacy is large air intake and exhaust ducting (in gas turbine powered ships, the air intake and exhaust uptake ducting are typically very large), which occupy much of the upper decks and superstructure. The weight and required space for shafting and ducting may add 50% to the weight and space requirements of the main electric and power producing machinery. Moreover, highly desirable spaces near the center of gravity of the ship, where ride motion is minimal, are dedicated to machinery and ducting, not to personnel living and working quarters. Furthermore, repairs are generally conducted in situ, often in inconveniently cramped quarters.

Further inefficiencies are introduced by the ship-service power generation machinery 26 and 28. Ship-service power (power other than propulsion power) has typically been produced by small turbines that operate at a low fraction of their design power and thus have net efficiencies near 15%. As a result, as much as one quarter of the fuel consumed at cruise speeds is used for "hotel loads" such as heating, ventilation, air conditioning, lighting, food and fresh water production, fire protection, i.e., non-propulsion related, ship-service power.

Moreover, hulls have customarily been designed for transverse stability and roll frequency at full-load displacement (full payload including full-fuel-load) with the required beam for stability being constant above the design waterline, i.e., vertical topsides 10 as shown in FIG. 1. To maintain transverse stability throughout the mission, ship hulls designed for stability at full-load require sea water ballast to compensate for expended fuel. In the past, as fuel was burned, sea water was pumped into the fuel tanks, and was then pumped out upon refueling. However, using emptied fuel tanks for ballast water increases pollutants discharged from the ship as "dirty" ballast is pumped into surrounding water. In accordance with international pollution control limits, future fuel tanks may not be ballasted by dischargeable water. The current Navy procedure is to build excess clean water ballast tanks. Excess ballast tanks, however, are wasteful of ship space, and carrying seawater increases fuel consumption late in the mission.

The price of the conventional prior art ship configuration is increased initial cost, increased fuel cost, and decreased capability. Consequently, there is a need to provide a more affordable, more capable, less polluting vessel. Such a vessel should use internal space more effectively than conventional vessels and should have adequate transverse stability without adding ballast as fuel is burned. The present invention is intended to overcome problems associated with prior art ship designs.

OBJECTS OF THE INVENTION

Accordingly, it is an object of the present invention to provide an affordable, capable ship having lower resistance, reduced power requirements, reduced fuel consumption, and reduced environmental impact when compared to conventional monohulls (as described above) with similar missions.

It is a further object of the present invention to provide a ship having simplified fabrication and reduced initial costs, as well as simplified maintenance and reduced operating and maintenance costs.

It is a yet a further object of the present invention to free midship spaces for more effective use as personnel living and working areas.

It is still a further object of the present invention to provide a ship having reduced wake, acoustic, infrared and radar detectability.

Other objects and advantages of the present invention will become apparent to those skilled in the art upon a reading of the following detailed description taken in conjunction with the drawings and the claims supported thereby.

SUMMARY OF THE INVENTION

The foregoing objects and advantages result from an innovative machinery-driven ship design centered on simplicity and efficiency. In accordance with the present invention, an improved vessel having main machinery modules located outside a watertight tumble home hull is provided.

The vessel includes a watertight hull having a stem bow and a tumble home hull configuration comprising a longitudinally extending hull bottom having a maximum beam corresponding to the uppermost port and starboard extensions of the hull bottom, port and starboard inward-sloped topsides extending upward from the uppermost port and starboard extensions of the hull bottom, a longitudinally extending weather deck disposed between the uppermost longitudinally extending end of each port and starboard topside, and a substantially vertical aft end disposed between the aft ends of the port and starboard topside, the hull bottom, and the weather deck. The maximum beam corresponds to the zero-fuel-load design waterline of the vessel. All propulsion shafting is located outside the watertight hull in aft mounted propulsor modules, consequently, no penetrations of the watertight hull for accommodating propulsion shafting are necessary. The vessel further includes a deckhouse structurally integral with the primary structural girders of the vessel. The deckhouse is located above the weather deck at a substantially centrally located portion of the vessel. A composite material steeple is attached to the deckhouse and contains rotating and stationary antenna in coaxial alignment therein.

A plurality of pretested, prealigned, removable propulsion modules are mounted outside of the watertight hull. The propulsion modules are installed after construction of the watertight hull and further are removable and replaceable without drydocking, thereby lowering maintenance costs. The propulsion modules comprise at least one steerable propulsor module and at least one power module. The steerable propulsor modules are attached to the stern of the watertight hull and provide means for both propelling and steering the vessel. The power modules may be mounted above the weather deck, preferably in the deckhouse, or directly above the propulsor module, or a combination of the two locations. Each power module includes therein power producing means capable of providing both ship-service power and propulsion power. Each power module is in electrical communication with one of the steerable propulsor modules for providing propulsion and steering power to the steerable propulsor module.

Each propulsor module includes a steerable pod aligned to the water inflow. An integrated machinery capsule, inserted into the front end of the pod, drives contrarotating tractor propellers that reduce power requirements, wake detectability, and sonar detectability. The integrated machinery capsule contains seals, thrust bearings, contrarotating reduction gears, and an alternating-current electric motor. A streamlined strut connects each pod rigidly to a rotatable barrel shaped machinery room containing steering machinery and individually replaceable propulsion auxiliaries. The rotatable barrel is mounted in a large diameter roller bearing fixed to the bottom of the propulsor module housing and is rotated by a two-stage orbital gear and electric drive that are attached to the roller bearing. By rotating the barrel, the attached strut and steerable pod are rotated, thus, providing the variable thrust vector to steer the vessel.

Each power module includes a gas turbine, a ship-service alternator, and a propulsion alternator. Since each power module is located outside the watertight hull, rather than deep in the midships section, inlet and exhaust ducts are short and light with low pressure drop to enhance turbine efficiency.

The present invention results in a vessel wherein all main machinery is modular, is located outside the watertight portion of the hull, is installable after hull construction has been completed, and is pierside replaceable. The vessel has a tumble home hull, i.e., a hull having inward-sloped topsides. The vessel is long and slender, having a Froude number at sustained speed $<0.38$, thus requiring reduced power at sustained and maximum speeds when compared to conventional high speed displacement hulls. The deckhouse, which may include a helicopter hanger, is a structurally integral part of the hull girders, thus reducing structural weight and reducing vulnerability to structural damage. A composite material steeple containing fixed and rotating communication and radar antennas is attached to the top of the deckhouse.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding element throughout and wherein.

DETAILED DESCRIPTION OF THE PREFERRED EMBODIMENT

Figure 1:
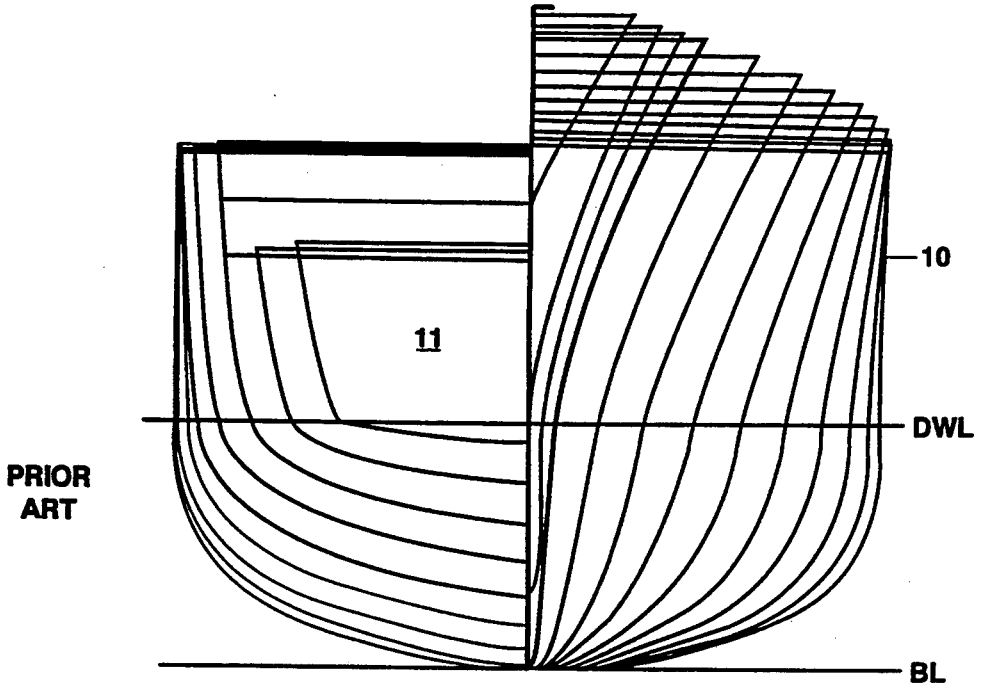
FIG. 1. is a body plan of a prior art monohull having vertical topsides.
Figure 2:
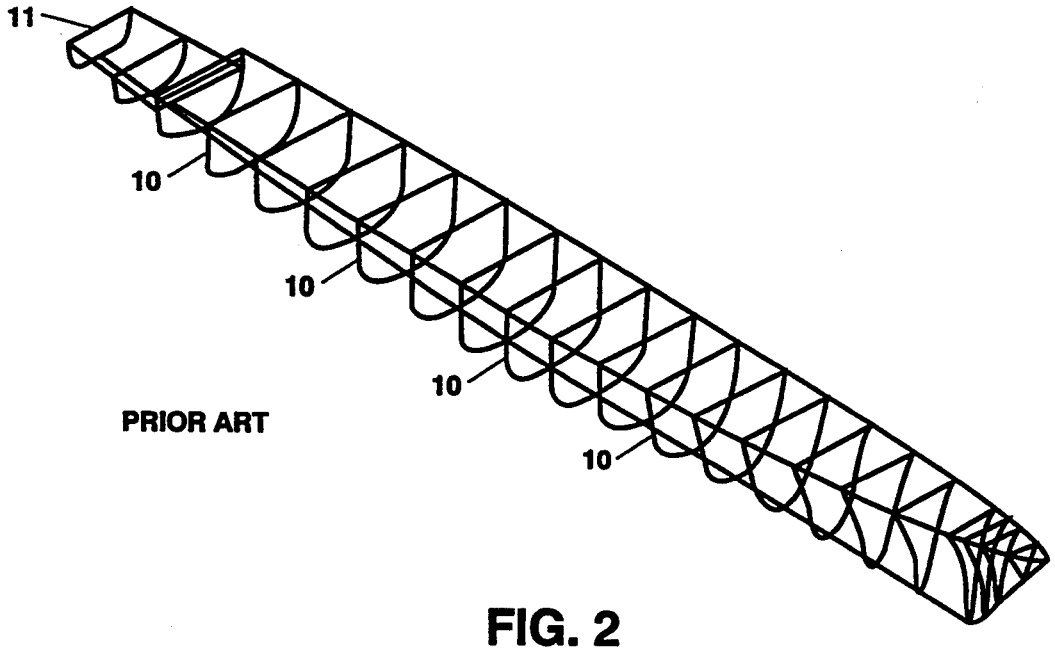
FIG. 2. is an isometric view of a prior art monohull.

A systematic description of the design considerations that resulted in the present invention are presented in two published reports: [1] Levedahl, William J., Samuel R. Shank, and William P. O'Reagan, "DD21A—A Capable, Affordable, Modular 21st Century Destroyer," Carderock Division Naval Surface Warfare Center report CARDIVNSWC-TR-93/013, December 1993, pp. 1–266; and [2] Levedahl, William J., "A Capable, Affordable, 21st Century Destroyer," Naval Engineers Journal, Vol. 103, No. 3, May 1993, pp. 213–223. These two reports, authored by the inventor and describing the present invention, are incorporated herein by reference.

Referring now to the drawings, and particularly to FIGS. 5–8, the present invention comprises watertight hull 40 having stem bow 42 and a tumble home configuration. Herein, "tumble home" refers to a hull having topsides 44 (generally the hull sides above the waterline) having an inward-sloped angle relative to vertical. Although in the preferred embodiment, the tumble home angle is constant, more than one angle to the vertical is within the scope of the present invention.

Watertight hull 40 comprises longitudinally extending hull bottom 46, port and starboard tumble home topsides 44 extending upward from port and starboard uppermost extensions 54 of hull bottom 46, longitudinally extending weather deck 48 disposed between uppermost ends 50 of port and starboard topsides 44, and a substantially vertical aft end 52 disposed between aft ends of port and starboard topsides 44, hull bottom 46, and weather deck 48. The maximum beam is defined by port and starboard uppermost extensions 54 of hull bottom 46 and corresponds to the zero-fuel-load design waterline (DWL) of the vessel.

Watertight hull 40 is separated longitudinally into a plurality of survivable watertight compartments 56 each of the compartments having at least one auxiliary machinery module 58 mounted therein. There are no penetrations of bulkheads 57 of compartments 56 for accommodating propulsion power generation or transmission machinery. Each auxiliary machinery module 58 includes heating means (e.g., electric heater, heat pump), air conditioning means (e.g., air conditioner, heat pump), ventilation means (e.g., fans), fire suppression means (e.g., water supply and pump connected to separate self contained fire extinguishment system located in each compartment), and backup electric power means (e.g., batteries, generator). Heating, air conditioning, ventilation, fire suppression, and backup electric power means all comprise conventional hardware and are, therefore, shown only schematically in FIGS. 8 and 13 as auxiliary machinery modules 58. A heat pump, using seawater as a source or sink, is a preferred means of heating and air conditioning.

Deckhouse 60 is structurally integral with watertight hull 40. Deckhouse 60 is located above weather deck 48 at a substantially centrally located portion of the vessel and, in combatants, preferably includes helicopter hanger 62, which houses, among other things, helicopters 64 and auxiliary boats 66. Deckhouse 60 is preferably made of structural steel to provide protection from explosions to deckhouse mounted machinery equal to protection provided to conventional hull mounted machinery. Composite material steeple 68 is attached to deckhouse 60. A constant tumble home angle throughout the hull topsides, continues uninterrupted into deckhouse 60 and steeple 68. Composite materials for steeple 68 include fiber reinforced matrix materials such as fiberglass and carbon reinforced organic resin matrix materials. Composite material steeple 68 contains rotating and stationary communication and radar antennas 70 in coaxial alignment therein, each of antennas 70 transmitting within a narrow frequency range. The inside walls of composite material steeple 68 may have radar-reflective coatings or shielding (not shown) thereon. The coatings or shielding are operative to reflect radar originating from without the vessel but allow a narrow-band transmission from the antennas. For example, selective shielding may be provided by an aluminized mylar shield having the aluminum coating etched off to from slots that allow specific wavelengths to pass through. Longer wavelengths require larger slots. Combatants may include armaments such as main 5"/54 calibre guns 72, close in weapons system 74, Vertical Launch System 76, and other high energy weapon systems.

The tumble home topsides 44 of watertight hull 40 preferably have a constant inward slope angle of between about 10° and about 12° to vertical. However, multiple angles to the vertical are an alternative. If more than one angle is employed, to reduce radar reflection the angles shall not intersect at a 90° angle. Watertight hull 40 may further include flared topsides 78 below the weather deck and flared bulwarks 80 above the weather deck. Flared topsides 78 and bulwarks 80 extend aft from stem bow 42.

A constant tumble home angle throughout the hull topsides, continued uninterrupted into the deckhouse and steeple, minimizes the number of angles from which radar return is received. This hull characteristic, combined with the elimination of right-angles at any intersection, decreases detectability from ships, surface-skimming missiles, and satellites. A clean outer surface enhances the low radar cross-section; most deck machinery, bitts, bollards, cleats, stanchions, lifelines, etc., should be hidden from view, designed for low radar reflection (e.g. conformal), be non-metallic where possible, and preferably be retractable. Rotating antennas 70 are coaxially mounted in steeple 68, thus reducing radar reflection and maintenance. A constant tumble home angle of between 10° and 12°, reduces radar cross-section by over 40 dB (a factor of more than 10,000) compared to conventional vertically sided ships (as shown in FIGS. 1-4).

Figure 11A:
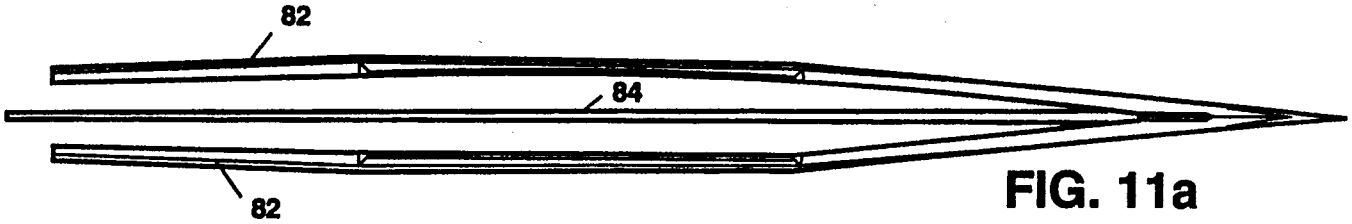
FIGS. 11*a*. and 11*b*. are top and side views, respectively, of the main structural members of the present invention.
Figure 11B:
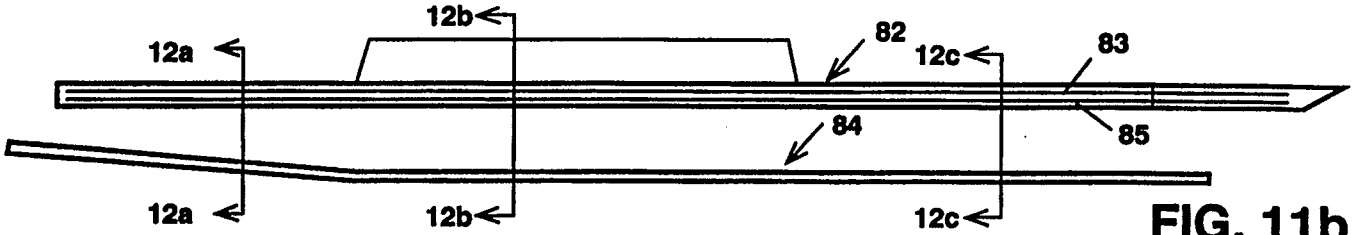
Figure 12C:
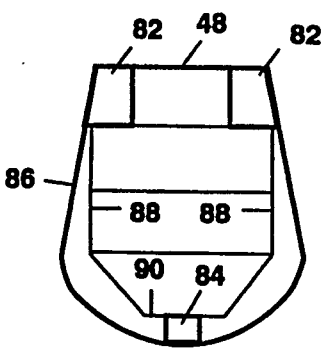
FIG. 12*a*., 12*b*., and 12*c*. are cross-sectional views taken along lines 12*a*, 12*b*, and 12*c*, respectively.
Figure 12B:
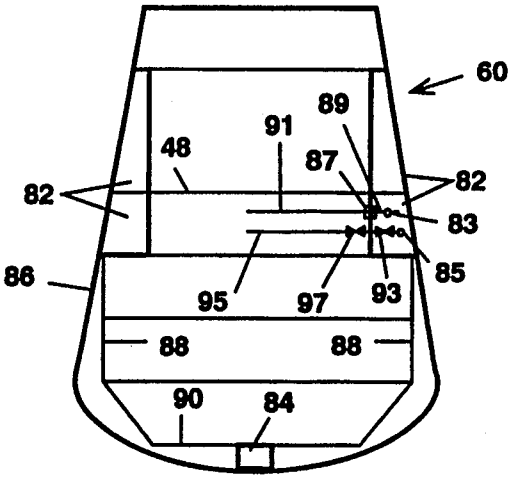
Figure 12A:
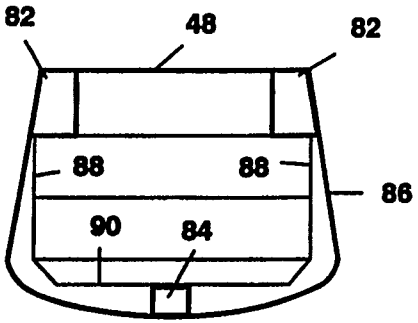
Figure 13:
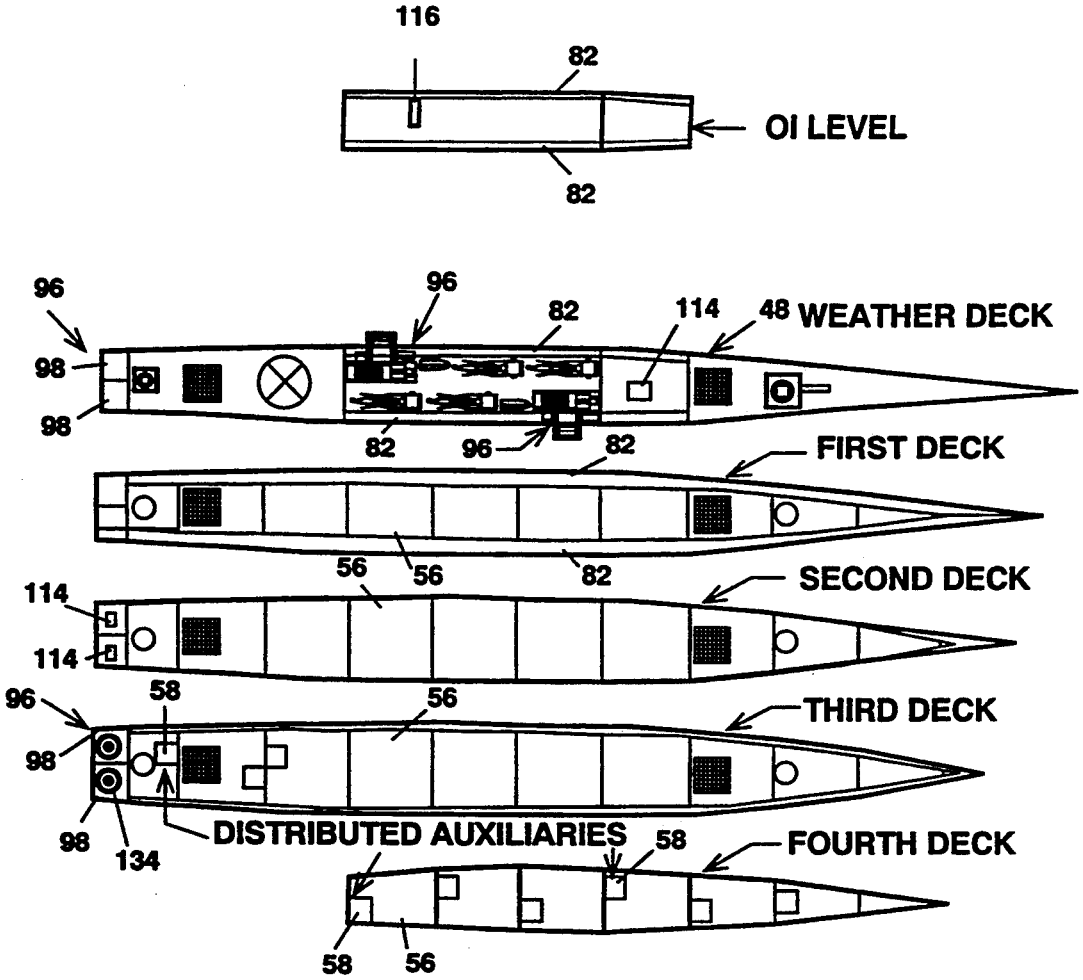
FIG. 13. is an exploded view showing the decks of FIG. 14.

Referring to FIGS. 11-13, primary structural members of watertight hull 40 include two longitudinally continuous box girders 82 and longitudinally continuous keel 84. Additional primary strength members include outer shell plating 86, inner hull sides 88 and bottom 90, top surface 92 of deckhouse 60, and forward transverse side 94 of deckhouse 60. The box girder configuration of the present invention increases the probability of survival after shallow-water mine explosions because it resists whipping deformations of the hull. The box girders 82 also serve as continuous ducts along each side of the hull just below weather deck 48 and, thus, may carry all longitudinal piping and electrical communication and transmission means. Thus, watertight hull 40 requires no penetrations to accommodate propulsion machinery except for one or more apertures in at least one box girder 82 for accommodating transmission of electric power from at least one power module 100 to at least one steerable propulsor module 98. Additionally, by placing all longitudinally running ducts, cables, lines, pipes, and conduits within box girders 82, no penetrations of bulkheads 57 are required.

Box girders 82 and keel 84 extend substantially from stem bow 42 to aft end 52 of watertight hull 40. Box girders 82 define an intersection of inward-sloped topsides 44 and weather deck 48 and extend from weather deck 48 downward one deck (nominally 9 ft). The portion of box girders 82 adjacent deckhouse 60 extend upward from weather deck 48 substantially to deckhouse top surface 92 and define longitudinally extending inward-sloped sides of deckhouse 60. Structurally integral deckhouse 60 increases the hull-girder section modulus over the longitudinally central part of the ship which incurs the maximum hogging or sagging moments, thereby permitting reduced thickness and weight of the girder members. Box girders 82 preferably contain a plurality of longitudinally extending electric cables 83 and fluid carrying pipes 85 therein. Additionally, at least one of box girders 82 preferably contains longitudinal walkways (not shown) functioning to provide personnel access, through watertight doors in the girders, among the plurality of survivable compartments 56.

Figure 14:
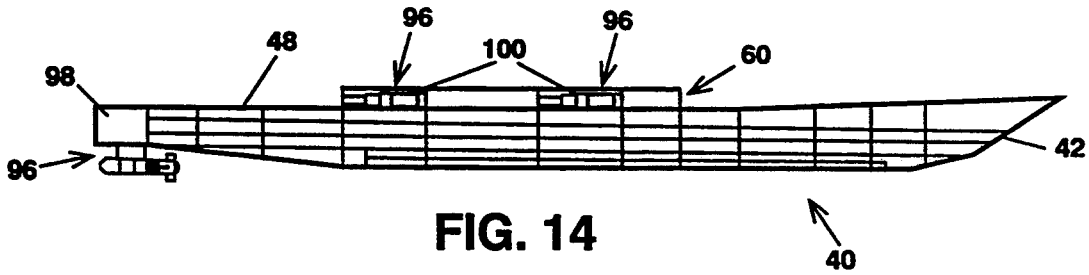
FIG. 14. is a side view of the present invention showing machinery modules mounted outside the watertight hull.
Figure 15:
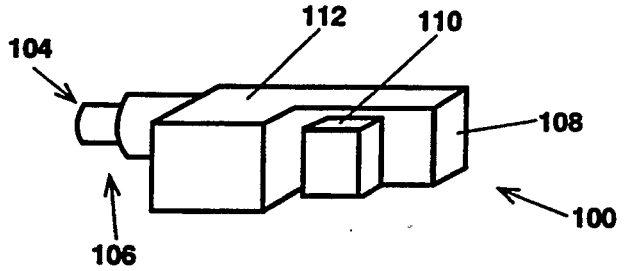
FIG. 15. is an isometric view of the power modules of the present invention.

A basic damage stability requirement exists. The ship must be stable with any two adjacent compartments 56 flooded. Since there are no main machinery systems (i.e., main propulsion and ship-service power generation machinery) inside watertight hull 40, the long machinery compartments 16 and large vertical trunks that contain air duct 18 and 20, which are present in conventionally configured hulls (see FIG. 3-4), do not exist in the present invention. Consequently, watertight hull 40 can be compartmented freely to meet the damage stability requirements. Furthermore, as shown in FIG. 14, the deck heights can be uniform and of constant height, which is not possible in conventional ships having large machinery compartments amidships. Consequently, ship volume may be reduced. Watertight hull 40 is separated longitudinally into a plurality of survivable compartments 56, each containing its own auxiliary machinery module 58. Each survivable compartment 56 is self-sufficient except for long-term electric power. No air, gas, or liquid lines penetrate compartments 56, except those from box girders 82 (i.e., no compartment bulkheads 57 are penetrated). Girder mounted and compartment mounted electric lines or cables communicate electrically through conventional watertight electric connector plugs mounted in the girder wall adjacent each compartment. All liquid or gas pipes that penetrate girders 82 into compartments 56 are sealed at the penetration and have conventional shutoff valves on each side of the girder wall.

A plurality of watertight, insulated electrical connector plugs 87 penetrate the wall of at least one box girder 82. At least one of plugs 87 is located adjacent each of compartments 56. Each plug 87 is in electrical communication, by way of transverse branch cable 89, with at least one of longitudinally extending cables 83 in box girders 82 and is further in electrical communication with at least one cable 91 in compartment 56. In addition, a plurality of transverse fluid carrying branch pipes 93 penetrate the wall of at least one box girder 82 adjacent compartments 56. At least one of pipes 93 is located adjacent each of compartments 56. Each transverse pipe 93 is in flow communication with at least one longitudinal pipe 85 in girder 82 and is further in flow communication with at least one pipe 95 in compartment 56. [Herein, when two elements are said to be in "flow communication" they are interconnected so as to be in flow communication by, for example, such well known interconnecting means as ducts, conduits, pipes, tubes, hoses, or any other suitable means for transporting a fluid.] Each transverse pipe includes a sealing means thereon, such as an O-ring, gasket, or other suitable well known sealing means (not shown), operative to create a watertight seal between the pipe and the box girder. Further, each transverse pipe includes a shut-off valve 97 on each side of the box girder wall.

Referring to FIGS. 7–10 and 15–17, a plurality of pretested, prealigned, removable propulsion modules 96 are mounted outside of watertight hull 40. Propulsion modules 96 are installable after construction of watertight hull 40 and are removable and replaceable pierside without drydocking. Propulsion modules 96 comprise at least one steerable propulsor module 98 and at least one power module 100. Steerable propulsor modules 98 are attached to aft end 52 of watertight hull 40 and function to both propel and steer the vessel. Power modules 100 may be mounted above weather deck 48, preferably in deckhouse 60 (see FIGS. 7–9), or directly above propulsor modules 98 (see FIG. 10), or a combination of the two locations. When mounted above propulsor modules 98, power modules 100 will include outer housing 101 forming a natural extension to watertight hull 40.

Each power module 100 preferably includes therein an intercooled, recuperative (ICR) engine 102, a ship-service generator 104 powered by ICR engine 102 and functioning to provide non-propulsion related power to the vessel, and a propulsion generator 106 operatively connected with a propulsor module 98 to provide electric propulsion and steering power to propulsor module 98. Herein, "non-propulsion related power" refers to the maximum daily ship-service load experienced by the ship, i.e., all electrical power needed for routine, emergency, and combat operations that is not used by propulsor modules 98 to propel or steer the ship. Each intercooled, recuperative engine 102 includes a gas turbine 108, an intercooler 110 integral with the gas turbine, and a recuperator 112 integral with the gas turbine. Intercooler 110 and recuperator 112 are attached to gas turbine 108 and are incorporated into the normal engine cycle. Intercooler 110 cools air entering the high pressure compressor while recuperator 112 uses gas turbine exhaust air to pre-heat the combustion air and, thus, reduce fuel consumption over the full power range. Although an ICR gas turbine is preferred, any appropriately sized simple cycle gas turbine, such as for example General Electric LM2500 gas turbines used in present Naval destroyers or Rolls-Royce RB-211 aero engine family gas turbines, are within the scope of the present invention. Propulsion generator 106 includes a winding to provide electric propulsion power to a propulsor module 98 and may further include a coaxial high voltage winding capable of powering high energy weapon systems.

Additionally, the vessel may include a conventional battery energy storage system (shown schematically as 114) for providing ship-service power in the event the ship-service generator 104 fails or is taken off line. Battery energy storage system 114 employs ordinary lead acid batteries and large inverters that are distributed appropriately throughout the vessel, preferably in auxiliary machinery rooms, auxiliary machinery modules 58 within each compartment 56, rotatable barrel 134, and other appropriate locations.

Figure 10:
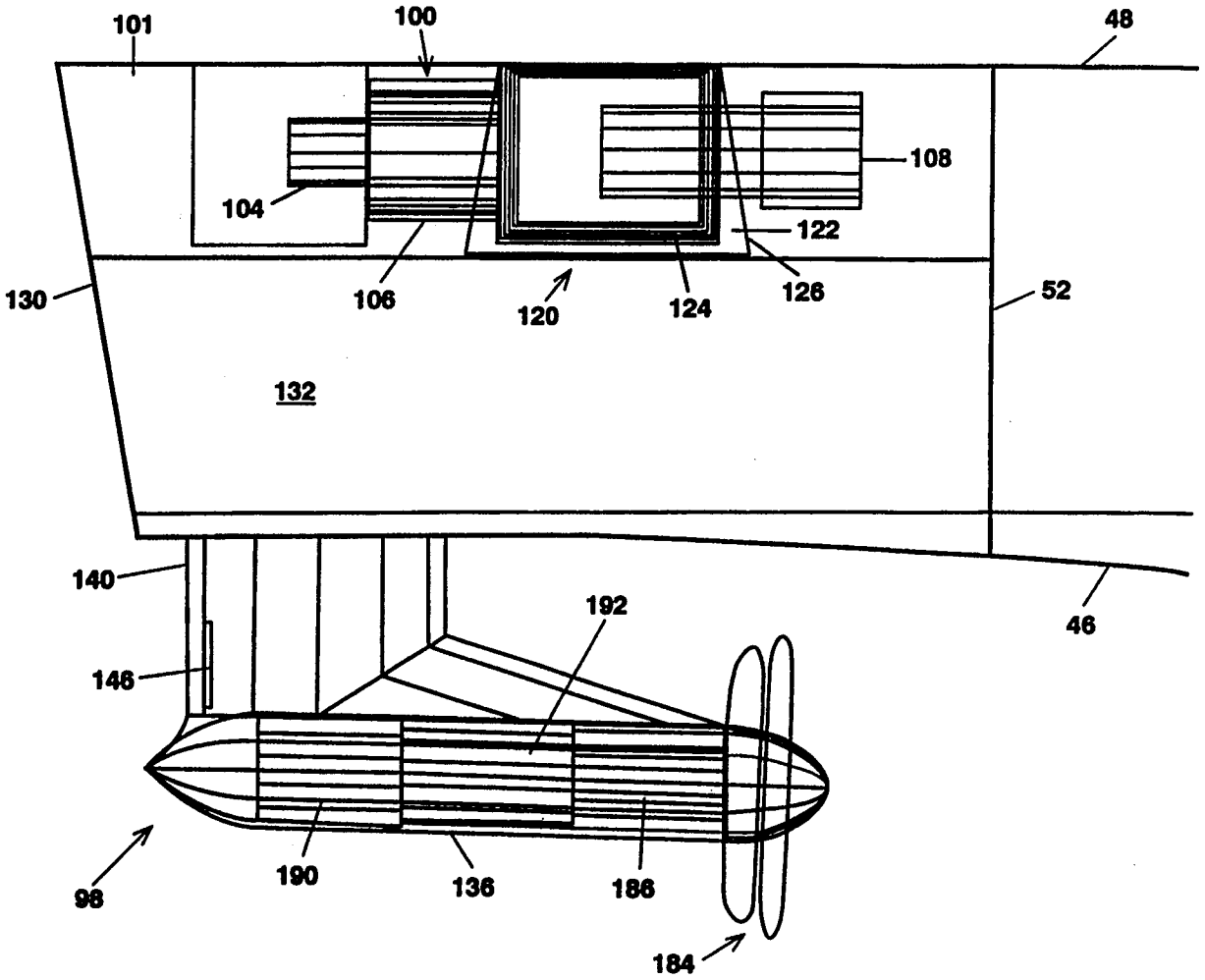
FIG. 10. is a side view of the stern section of the present invention showing stern mounted propulsor and power modules.

In the present invention, the main propulsion turbines are no longer within the confines of the watertight hull, thus air ducts are removed from the watertight hull freeing midships space for personnel use. As more fully described below, short, light, turbine air inlet 116 with side or aft facing inlet louvers 117 and inlet ducts 118 are mounted above and in flow communication with air intakes of deckhouse mounted power modules. If one of power modules 100 is mounted atop one of propulsor modules 98, as shown in FIG. 10, air inlet 116 will remain located atop deckhouse 60. However, inlet ducts 118 will run from power module 100, along the interior of continuous box girder 82, to air inlet 116.

Figure 18:
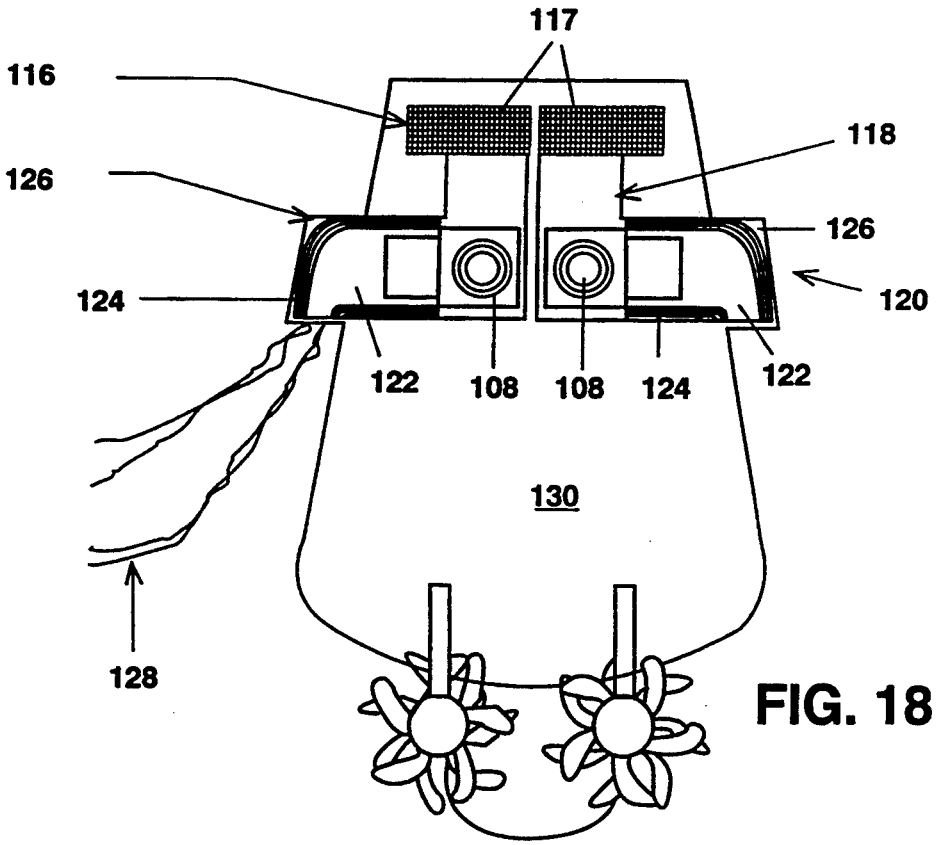
FIG. 18. is a stern view of the present invention.

The tumble home configuration of the present invention allows the engines to exhaust over-the-side (abeam) and downward without the exhaust ducts extending beyond the waterline beam of the ship and without occupying internal ship volume. As shown in FIG. 18, short-ducted, downward facing, infrared shielded, boundary layer air induction-cooled exhaust system 120 minimizes infrared detectability from any point above the horizon. Exhaust system 120 includes short over-the-side exhaust duct 122, mounted abeam and in flow communication with the exhaust of each power module 100, boundary-layer-induction signature suppressors (BLISS) 124, and radar reflecting exhaust caps 126. Radar reflecting exhaust caps 126 preferably have tumble home angles equal to those of watertight hull 40. Exhaust system 120 will be located adjacent power module 100 whether power module 100 is mounted in deckhouse 60 or atop propulsor module 98. If power module 100 is mounted in deckhouse 60, exhaust duct 122 will exhaust through a sidewall of deckhouse 60. Boundary-layer-induction signature suppressors (BLISS) systems exhausting upward are presently used with conventional shipboard gas turbines. When employed with the present invention, BLISS 124 exhausts downward. BLISS 124 is in flow communication with inlet ducts 118 and creates an unobstructed flow passage from inlet ducts 118 to the outlet of exhaust ducts 122. The exhaust gases exiting exhaust ducts 122 are at a lower pressure than the intake air and, thus, they draw cool air from inlet ducts 118 into the exhaust stream. Exhaust gasses from ICR engines are at lower temperatures than from conventional gas turbine propulsion engines (e.g., General Electric LM2500 gas turbines), BLISS 124 further dilutes exhaust gasses with cool air, and the exhaust is projected downward and outward toward the water surface so that exhaust plumes 128 have low visibility from other ships or low flying missiles. Alternatively, a short vertical uptake exhaust system having exhaust ducts mounted above the engines may be employed.

Steerable propulsor modules 98 form naturally shaped extensions to watertight hull 40 and will preferably define a transom stern 130 (see FIG. 19), although a cruiser stern variant is an alternative. Each steerable propulsor module 98 comprises outer housing 132, substantially vertical rotatable barrel-shaped auxiliary machinery room 134 rotatably mounted within outer housing 132, axisymmetric steerable pod 136 containing integrated machinery capsule 138 therein, and streamlined strut 140 rigidly connected at top end 142 to rotatable barrel 134 and rigidly connected at bottom end 144 to steerable pod 136. The number of propulsor modules varies according to the propulsion requirements of the ship, however, all propulsor modules are attached to the stern of the watertight hull. For example, a frigate may have one propulsor module, while a destroyer may require two, and larger hulls may be designed with three or more propulsor modules.

Outer housing 132 is secured to aft end 52 of watertight hull 40 and defines the vessel stern. Outer housing 132 forms the naturally shaped stern extension to watertight hull 40. Thus, outer housing 132 has tumble home topsides 145 extending aft from tumble home topsides 44. Transom stern 130 may have either a tumble home (inward-sloped) angle or a flare (outward-sloped) angle, the angle to vertical being equal to the tumble home angle of watertight hull 40. Streamlined strut 140 connects each pod 136 rigidly to a substantially vertically aligned rotatable barrel-shaped auxiliary machinery room 134. Each streamlined strut 140 has the maximum possible longitudinal length to minimize interference drag. Each strut 140 may include port and starboard ejection ports 146 for preferentially ejecting water to provide additional steering control. Manned entry into the rear of each pod from the machinery room is through the after part of the strut. Access forward is via the forward extension of the strut. The rotatable barrel contains steering means 148 and individually replaceable auxiliary propulsion machinery components (not shown) that support the propulsor system. Auxiliary propulsion machinery components may include oil pumps for the lubrication oil, heat exchangers (using seawater as the cooling medium) and water pumps for the coolant system, seals, and batteries for providing emergency power. Steering means 148 includes geared electric motor 150 and high-reduction-ratio gear system 151.

Figure 20:
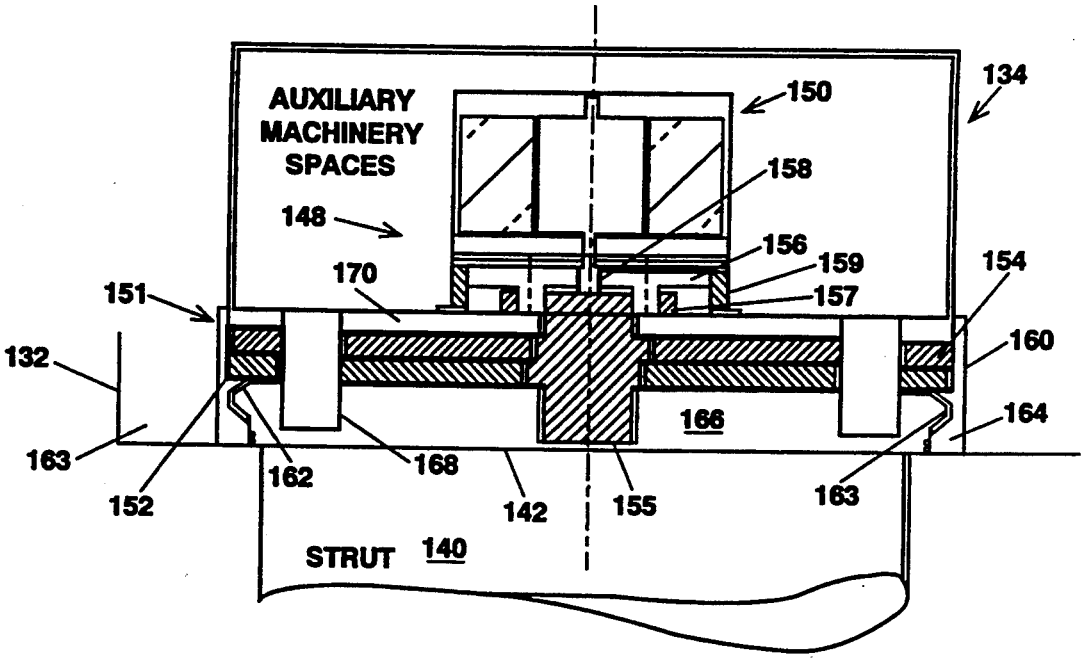
FIG. 20. is a cross-sectional view of the rotatable barrel of the present invention.
Figure 21:
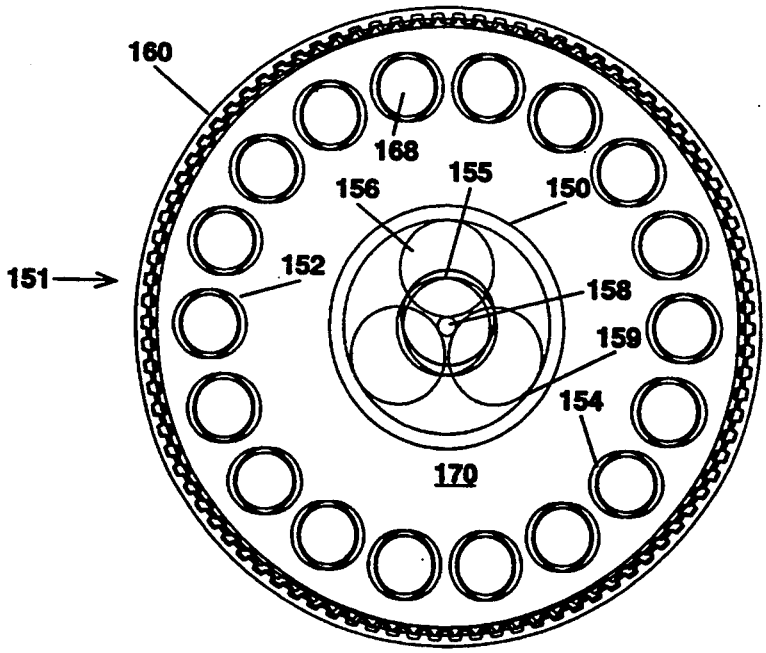
FIG. 21. is a top view of the steering means of the present invention.

Referring to FIGS. 20 and 21, steering during major maneuvers is accomplished by rotating pods 136 using rotatable barrel mounted electric motor 150 and high-reduction-ratio gear system 151. High-reduction-ratio gear system 151 includes dynamically balanced, high-reduction-ratio, dual orbital gears 152 and 154 orbited by cammed rotor 155, three planet planetary gear set 156 with associated planet carrier 157, sun gear 158 and ring gear 159, and gear system fixed ring gear 160. Lower orbital gear 152 and upper orbital gear 154 are 180° out of phase. Fixed ring gear 160 is rigidly mounted atop stationary member 164 of moderately loaded, large diameter roller bearing 162. Fixed ring gear 160 and roller bearing 162 are rigidly attached to base 163 of outer housing 132. Roller bearing 162 supports the entire steerable pod and rotatable barrel system and transmits thrust to propulsor module 98 and watertight hull 40. A plurality of vertical pins 168 pass through holes in lower orbital gear 152 and upper orbital gear 154, and are implanted in rotating base 166 at their bottom end and upper plate 170 at their top end. Strut 140 is rigidly attached to rotating base 166 which is attached to and rotates with gear system 151. Upper plate 170 rotates with pins 168 and rotating base 166, and is connected to ring gear 159 of planetary gear set 156. Orbital gears 152 and 154 are orbited by cammed rotor 155 which is driven by electric motor 150 through planet carrier 157 of planetary gear set 156. The holes in orbital gears 152 and 154 are larger than pins 168 by twice the cam eccentricity. Thus, pins 168 prevent orbital gears 152 and 154 from rotating relative to rotating barrel 134 but allows them to orbit. Orbital gears 152 and 154 each have one tooth less than does fixed ring gear 160. Consequently, rotating base 166 rotates through an angle corresponding to one gear tooth for each revolution of cam rotor 155. Three plant planetary gear set 156 combined with a 90 tooth fixed ring gear 160 provide a reduction ration of over 1,000:1. Steering means 148 is operative to rotate pods 136 rapidly through a 270° arc. Thus, fast turning or crashback is provided by rotating pods 136 through an appropriate angle. If two or more propulsor modules are employed, the pods are mounted such that the end of the pod aft of the axis of rotation is short enough not to interfere with adjacent pods during rotation.

Figure 22:
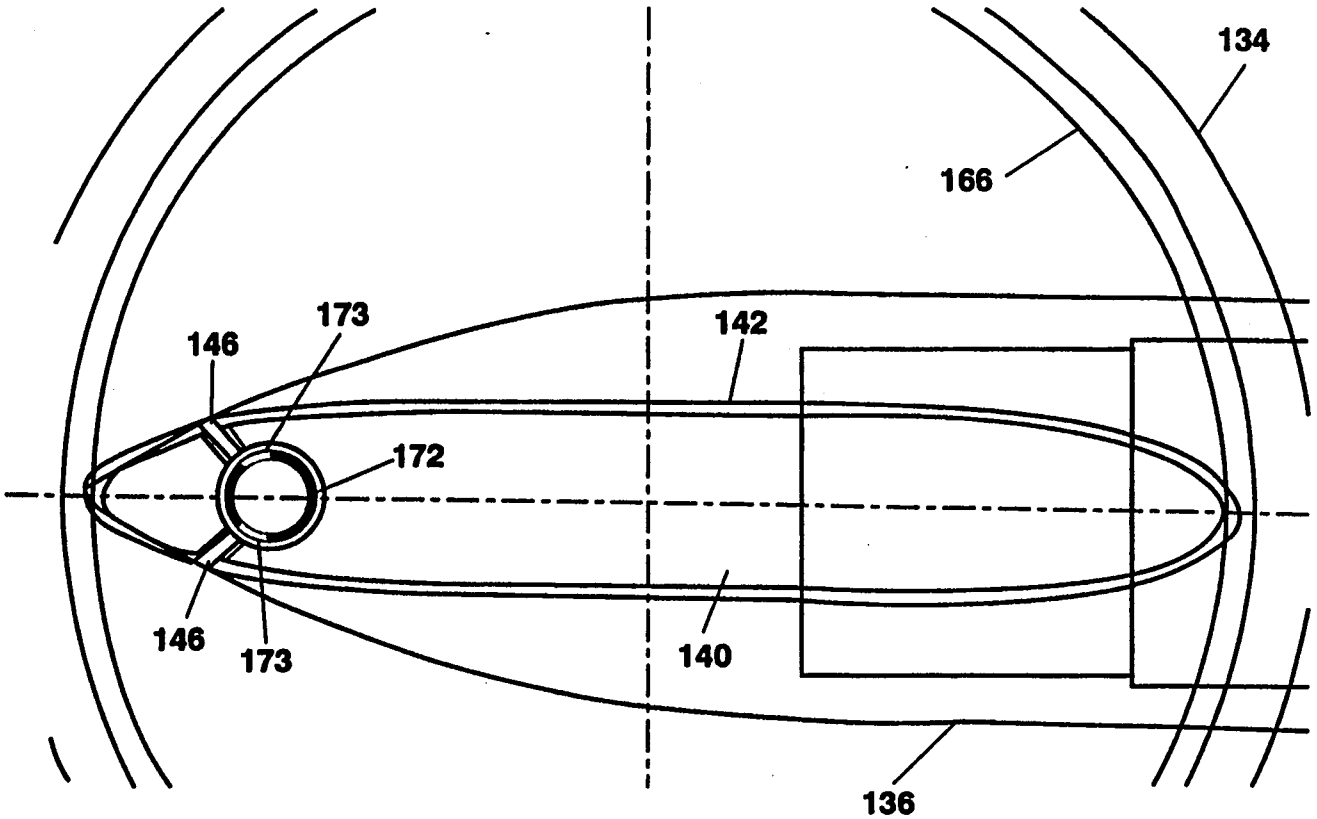
FIG. 22. is a cross-sectional view of the streamlined strut of the present invention showing the circulation control valve.

Small steering correction are quietly made by preferential ejection of coolant system seawater through ejection ports 146 in the port and starboard after-sides of struts 140, providing circulation control through the Coanda effect. The coolant system water pumps, located in auxiliary machinery spaces of rotatable barrel 134, are in flow communication with circulation control valve 172 and ejection ports 146. Coolant system seawater is pumped from rotatable barrel 134 through circulation control valve 172 to either or both of ejection ports 146. Circulation control valve 172 may include any well known control valve for providing preferential circulation to more than one outlet. As shown in FIG. 22, circulation control valve 172 may comprise a rotatable, cylindrical valve having slots 173 which align with ejection ports 146. By rotating valve 172, using for example an electric motor, flow may be closed off from both of ports 146 or may be provided to one or both of ports 146.

Figure 16:
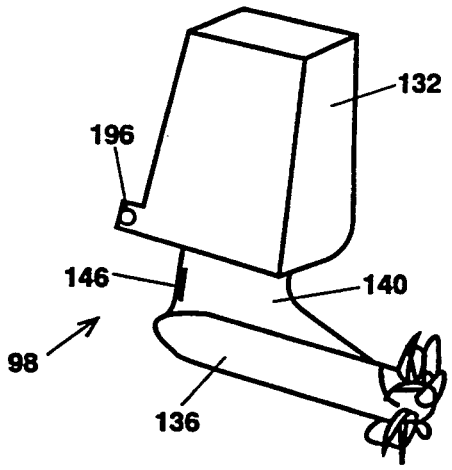
FIG. 16. is an isometric view of the propulsor modules of the present invention.
Figure 17:
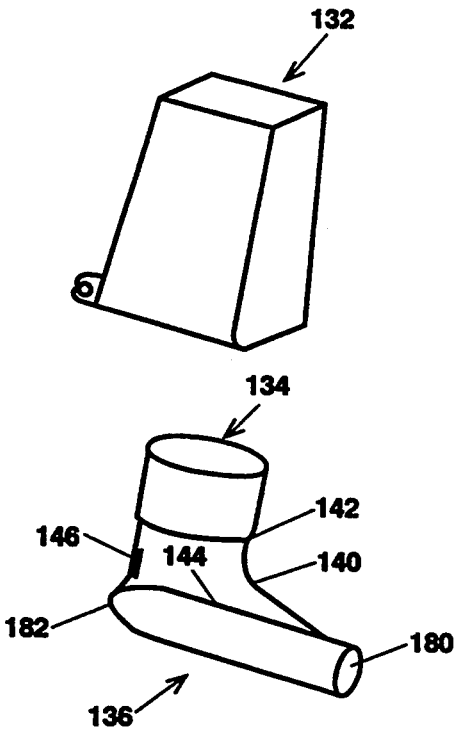
FIG. 17. is an exploded view of the propulsor modules of the present invention.
Figure 17:
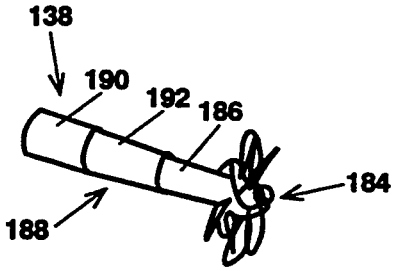

Referring to FIGS. 16 and 17, each pod 136 has an open forward end 180 and a pointed aft end 180. Pods 136 are aligned with the water flow around the after-end of the vessel to provide axial flow into propellers 184 during straight-ahead operation. Steerable pods 136 are preferably cylindrical and of the minimum diameter and length consistent with motor diameter and acoustic requirements (to accommodate acoustic mounts and acoustic insulation). Such pods produce less than half the resistance of prior art open shafts and struts.

Each pod 136 has mounted therein a prealigned, pretested integrated machinery capsule 138. Each integrated machinery capsule 138 contains contrarotating (CR) propeller shafts that extend forward of the pod open forward end and associated shaft seals and thrust bearings (represented schematically as 186), CR propellers 184 mounted on the forward end of the CR propeller shafts, and power means 188 functioning to rotate CR propellers 184. Power means 188 preferably comprises a liquid cooled alternating-current electric motor 190 and contrarotating reduction gear 192. Although CR propellers are preferred, conventional fixed pitch or controllable, reversible pitch propellers and their associated shafts, shaft seals, bearings and power means are also within the scope of the present invention.

Lightly loaded, CR tractor propellers, facing directly into the undisturbed flow stream outside the hull boundary layer, provide high efficiency and no cavitation up to 25 knots, except during sharp turns and rapid accelerations. Contrarotating propellers 184 are preferably highly skewed propellers. Contrarotating propellers with seven blades forward and five blades aft minimize both tip cavitation and acoustic signature. In addition, CR propellers sharply decrease the wake signature by avoiding major wake vortex that brings cooler subsurface water to the surface.

A CR reduction gear system suitable for the present invention will reduce output rotational speed and increases total output torque as compared to input rotational speed and torque. Any suitably sized prior art CR reduction gear system is compatible with the present invention. However, a ring-ring bicoupled contrarotating epicyclic reduction gear is preferred. Alternatively, the integrated machinery capsule may contain CR propellers and shafts, seals, a thrust bearing, and a contrarotating DC acyclic superconductive hexapolar motor.

Figure 23:
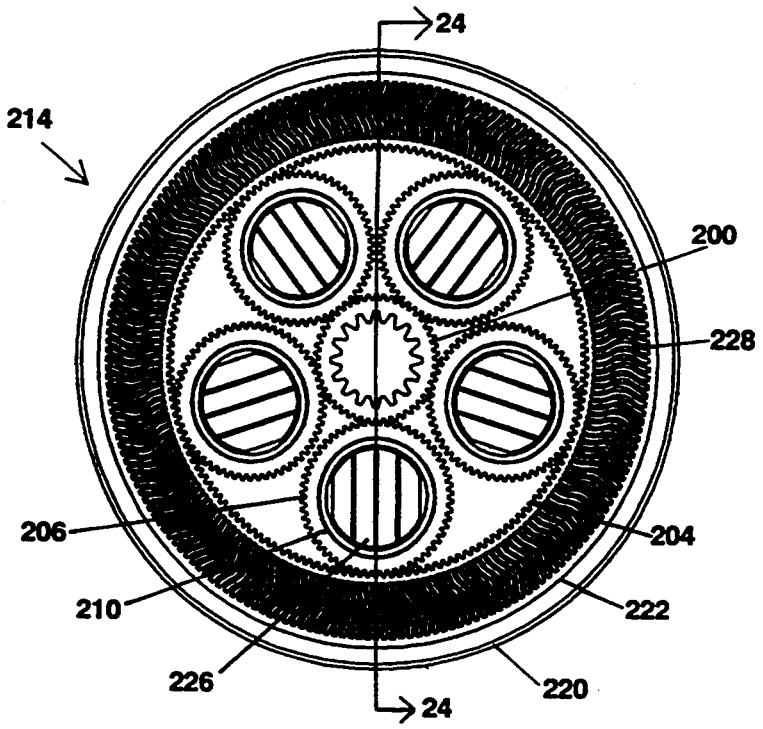
FIG. 23. is a cross-sectional end view of a ring-ring bicoupled contrarotating epicyclic reduction gear of the present invention taken along line 23 of FIG. 24.
Figure 24:
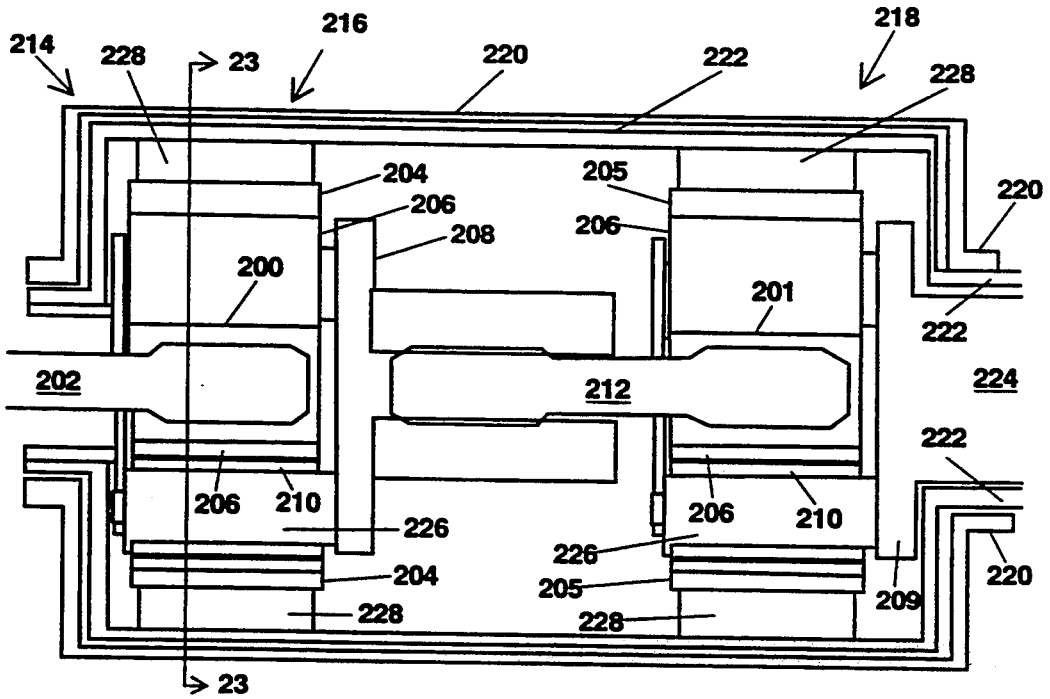
FIG. 24. is a cross-sectional side view of a ring-ring bicoupled contrarotating epicyclic reduction gear of the present invention taken along line 24 of FIG. 23.

Referring to FIGS. 23 and 24, a simple epicyclic reduction gear (e.g., first-stage epicyclic reduction gear 216 of FIG. 24) consists essentially of: (1) a central, externally toothed sun gear 200 connected to a rotating input shaft 202; (2) an internally toothed ring gear 204 connected to an outer output-torque carrier and concentric with sun gear 200; (3) one or more externally toothed planet gears 206, each of which meshes with both sun gear 200 and ring gear 204; (4) a planet carrier 208 having spindles 210, one spindle central to each planet gear carries the net load on that planet gear; and (5) an inner output-torque carrier 212 connected to planet carrier 208 and coaxial with sun gear 200 and ring gear 204. The above described simple epicyclic reduction gear becomes a contrarotating (CR) reduction gear when ring gear 204 is connected to a rotating outer output shaft and inner output-torque carrier 212 is connected to a rotating inner output shaft that rotates in the opposite direction of the outer output shaft, as would be the case when the CR gear is connected to CR propellers 184. The torque on planet carrier 208, and thus the inner output shaft, is equal and opposite to the sum of the torques on input shaft 202 and the outer output shaft.

When the ratio between output and input torques needs to be larger than that achievable by a small diameter simple epicyclic gear, a "two-stage" epicyclic reduction gear may be used. In conventional two-stage "singly coupled" CR reduction gear, the high-torque output of the first-stage epicyclic gear (a star gear if the planet carrier is non-rotating or a planetary gear if the ring gear is non-rotating) is coupled to the sun gear of the second-stage, CR, epicyclic gear.

A preferred CR reduction gear for use with the present invention is "ring-ring bicoupled contrarotating epicyclic reduction gear" 214 having a two-stage epicyclic configuration with first-stage epicyclic gear 216 and second-stage epicyclic gear 218 rotatably mounted in outer casing 220, as shown in FIG. 24. Ring-ring bicoupled CR epicyclic reduction gear 214 is characterized by: first-stage planet carrier 208 being connected to second-stage sun gear 201 using interstage quill shaft 212; first-stage ring gear 204 and second-stage ring gear 205 being connected to outer output shaft 222; and second-stage planet carrier 209 being connected to inner output shaft 224. All members of both stages rotate and carry useful torque. Ring-ring bicoupled epicyclic CR reduction gear 214 provides the maximum reduction-ratio (maximum output torque) for two-stage reduction gears. Furthermore, the absolute ratio of inner to outer output torques is the minimum possible. Ring-ring bicoupled CR epicyclic reduction gear 214 also has lower centrifugal stress on the first-stage planet bearings than is the case with conventional CR gears having fixed ring gear first-stages and CR second-stages. Moreover, ring-ring bicoupled CR epicyclic reduction gear 214 includes vibration suppressing springs between all output gears and outer and inner output shafts 222 and 224. Planet spindle springs 226 built into the shafts of planet carrier spindles 210, and ring gear radial springs 228 built into spacers between, and rotatably connecting, ring gears 204 and 205 and the outer output shaft 222 provide means of reducing transmission of vibration.

An exemplary ring-ring bicoupled CR epicyclic reduction gear with four planet gears in the first-stage and seven in the second-stage will power CR propellers at a reduction ratio of approximately 30 to 1. In the seven-planet second-stage, each of the double-helical planet gears meshes with both sun and ring gears. The 28 meshes are out of phase, and each planet gear has about 100 teeth so that individual tooth engagements produce very small torsional accelerations. Flexible spindles and flexible-tooth ring-gear holders greatly attenuate vibrations before they reach the shafts and propellers.

Figure 19:
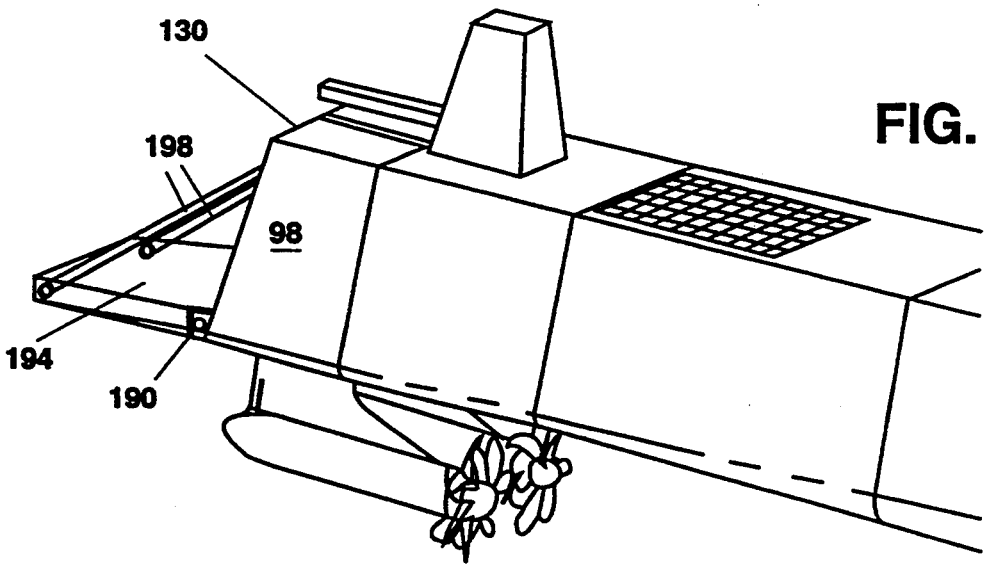
FIG. 19. is an isometric view of the stern of the present invention showing the retractable stern flap.

The present invention may further include stern flap 194 attached to a transom stern variant of propulsor module 98 (see FIG. 19). Stern flaps increase the effective ship length and decrease Froude number and, thus, resistance at high speeds. Stern flap 194 may be fixed or retractable, and in either case will provide a natural extension to the hull bottom when deployed. If retractable, flap 194 is rotatably or pivotally mounted to the bottom of the transom stern to form a natural extension to the hull bottom when extended. Retractable stern flap 194 is stowed substantially vertically against the stern of propulsor module 98. Stern flap 194 may be rotatably mounted in any conventional manner, such as hinge mounted on hinges 196. A retractable, variable angle stern flap 194 may be extended and retracted using any well known, suitable reciprocating means 198 for biasing stern flap 194 to variable positions, such as electric, pneumatic, or hydraulic powered ram, or electric motor/worm gear driven retractable pivot arm. A retractable, variable angle stern flap is advantageous when fuel is burned without the addition of seawater ballast. Under these conditions, displacement may decrease 20–45% from full-load values, and transom submergence may vary greatly. The flap can compensate advantageously for these changes in displacement as well as for changes in speed by producing trim and transom submergence which maximize performance at all loadings.

Crew comfort is ensured by adequate transverse stability, tolerably low roll frequency, good seakeeping in heavy seas, and crew working and living quarters as near as possible to the ship's center of gravity where motions are at a minimum. The preferred embodiment of the present invention is designed for adequate transverse stability with zero-fuel-load (as opposed to present practice of designing for stability at full-fuel-load and adding sea water ballast as fuel is burned to retain stability). The maximum beam is located at the zero-fuel design waterline. Tumble home above the design waterline prevents a rapid increase in roll frequency as fuel is added and thus adequate transverse stability is maintained as fuel is burned without the addition of ballast. In addition, the tumble home configuration reduces the change in roll resistance, roll frequency, and transverse stability as fuel is burned and displacement decreases. To ensure good head-seas seakeeping, the hull has a large waterplane forward (larger than present Spruance class destroyers) and a long waterline (Froude number at sustained speed $<0.38$). Moreover, by moving all major machinery (propulsion and ship-service power generating machinery) and ducting out of the midship spaces of the watertight hull, the center of the ship is available for personnel working and living areas.

EXAMPLES

The following examples are presented to illustrate the synergistic effects associated with the various innovative modifications of the present invention. Although the present invention is applicable to any large, displacement hull design, the following examples are based on high speed naval combatant hulls. Each example presents a modification of the preceding example. All examples incorporate conventional, well known machinery and all comparisons are based on conventional, well known prediction methods and, thus, details are not provided herein. In each case, comparisons are with the preceding example unless otherwise noted. (Details of weight, fuel consumption, and required power predictions are contained in the Appendix B of the aforementioned report entitled "DD21A—A Capable, Affordable, Modular 21st Century Destroyer.")

All examples assume ships having identical military payloads and armament suites, 30 knot sustained speed at 80% of installed power, and 6000 nautical mile (nmi) endurance range (range at 20 knots) except for Examples 9 and 10 having 12,000 nmi endurance ranges. Each ship is designed to have the exact power necessary to make the 30 knot sustained speed, thus, the engines are rated based on power required. All ships, except for Example 10, are designed for adequate transverse stability at full-load. Each ship maintains stability equal to the conventional hull of Example 1, thus, each ship has the same ratio of transverse metracentric height to beam (GMT/B=0,075). Example 10 is designed for adequate transverse stability at zero-fuel-load and thus retains some excess stability at full-load. All ships have a waterline length of 529 feet, except for Example 10 whose waterline length is 553 feet.

Figure 3A:
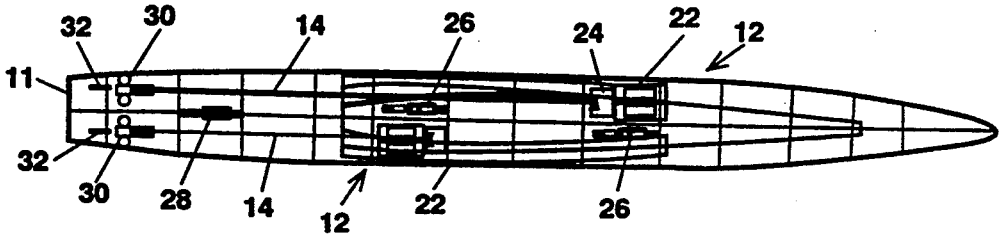
FIG. 3A PRIOR ART
FIGS. 3*a*. and 3*b*. are top and side views, respectively, of a prior art monohull showing conventional arrangement of main machinery.
Figure 3B:
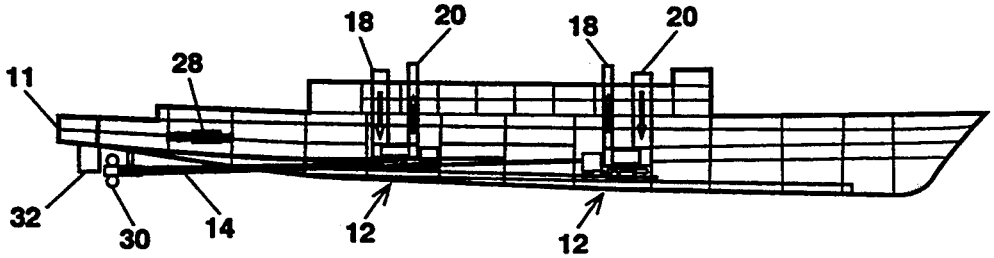
Figure 4A:
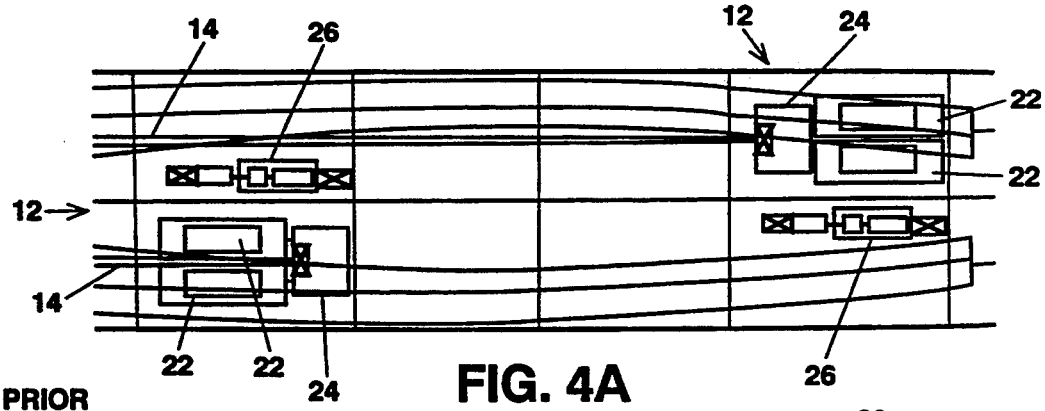
FIG. 4A PRIOR ART
FIGS. 4*a*. and 4*b*. are top and side views, respectively, of centrally located main machinery rooms on a conventional prior art monohull.
Figure 4B:
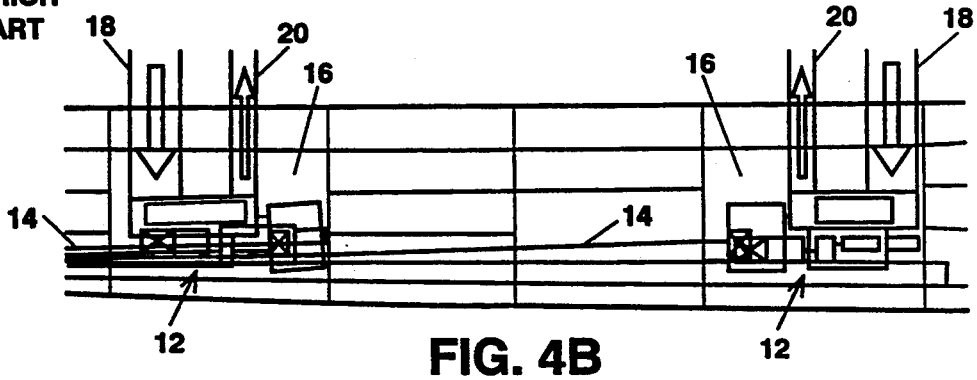
Figure 5:
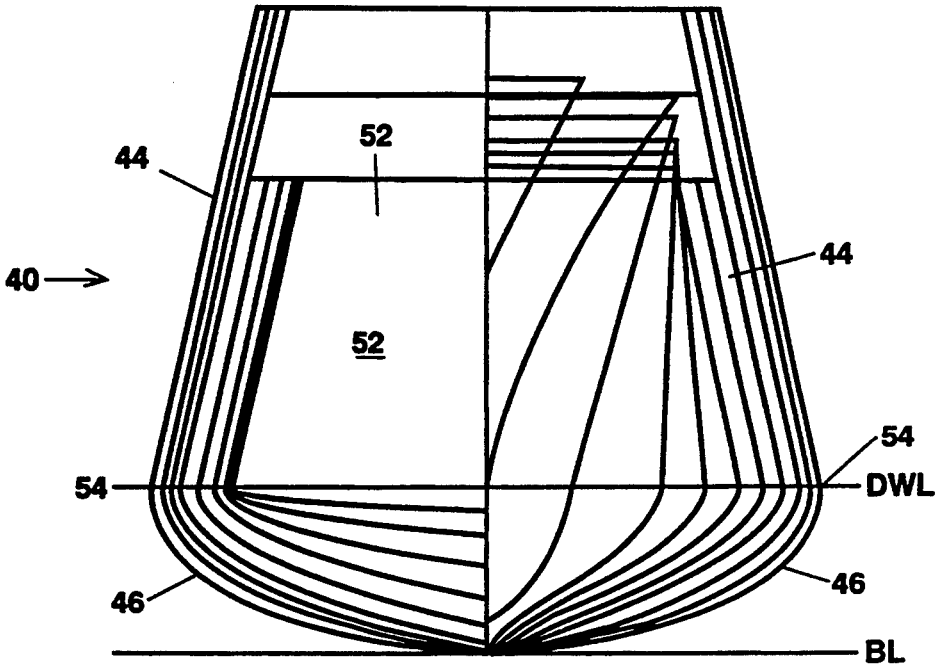
FIG. 5. is a body plan of a tumble home hull configuration in accordance with the present invention.
Figure 6:
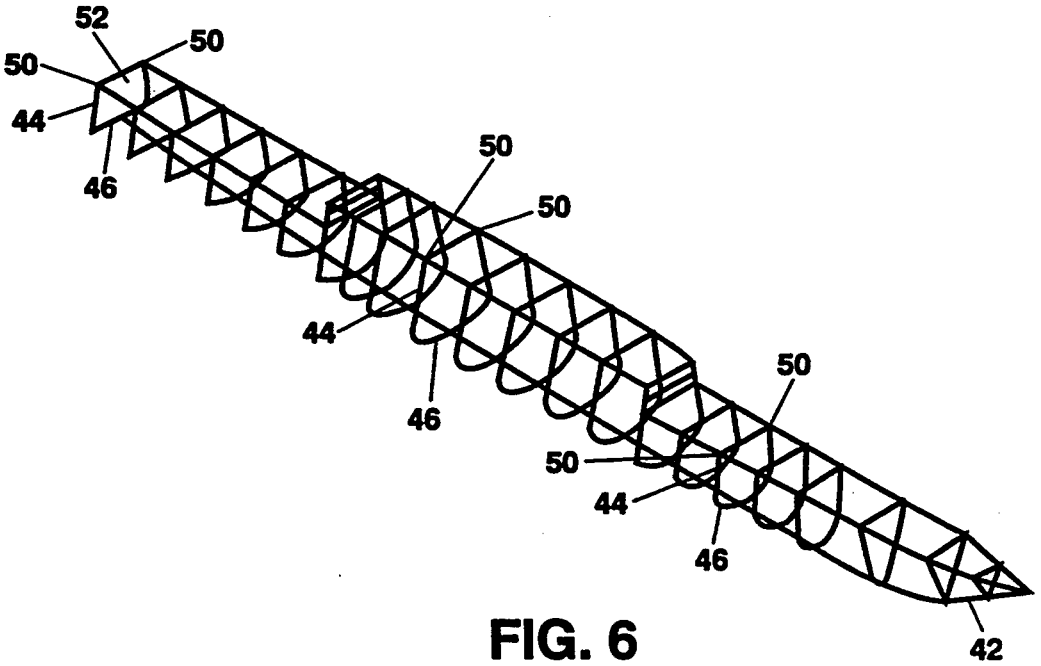
FIG. 6. is an isometric view of a tumble home hull configuration in accordance with the present invention.
Figure 7:
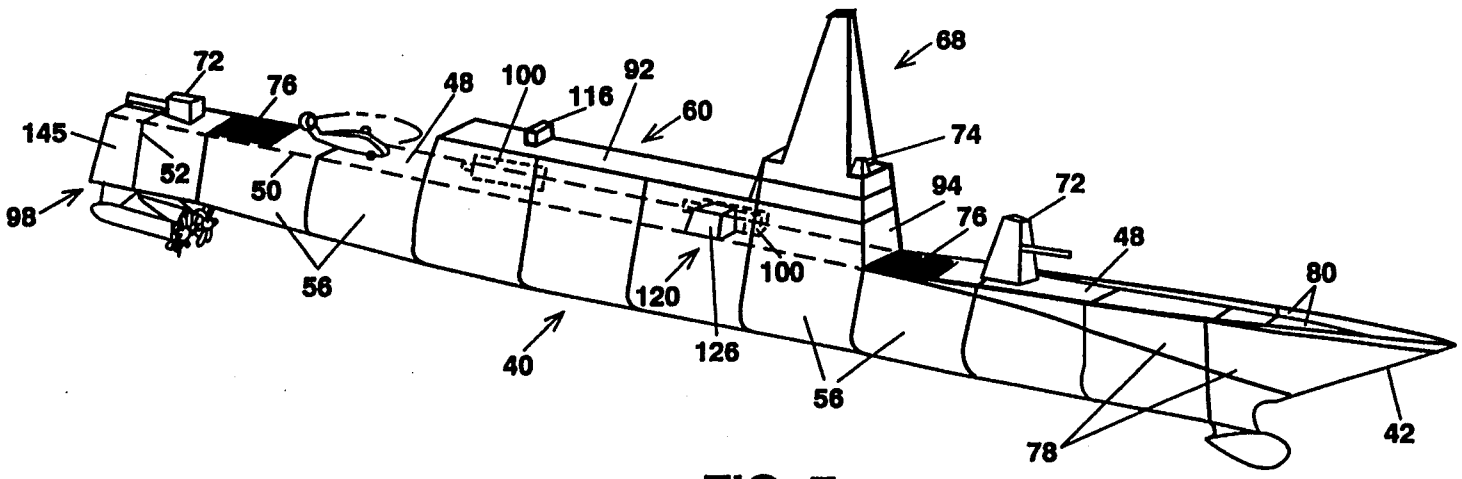
FIG. 7. is an isometric view of a preferred embodiment of the present invention.
Figure 8:
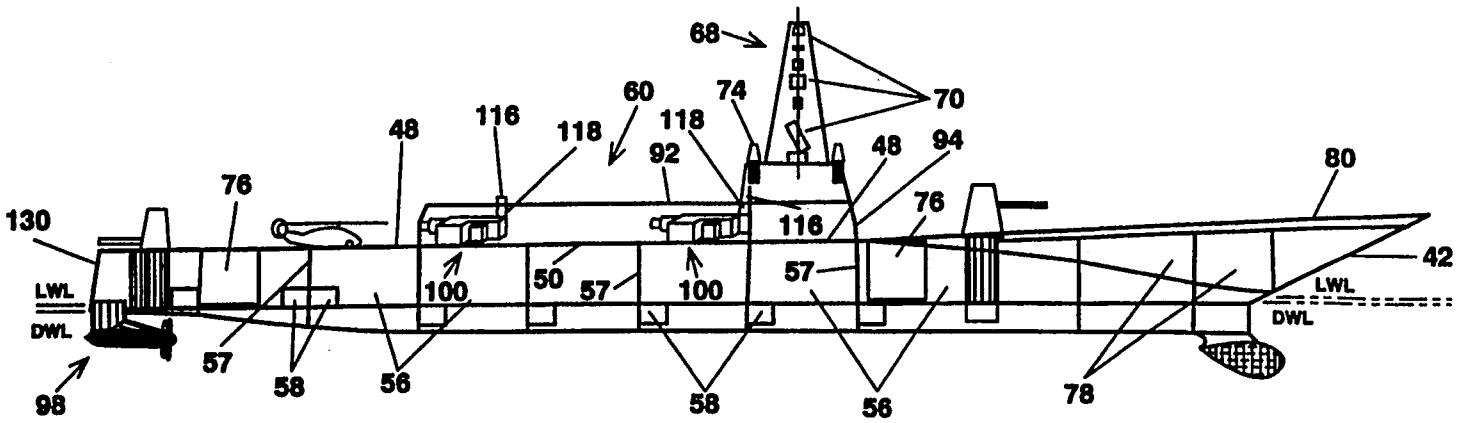
FIG. 8. is a cutaway side view of a preferred embodiment of the present invention.
Figure 9:
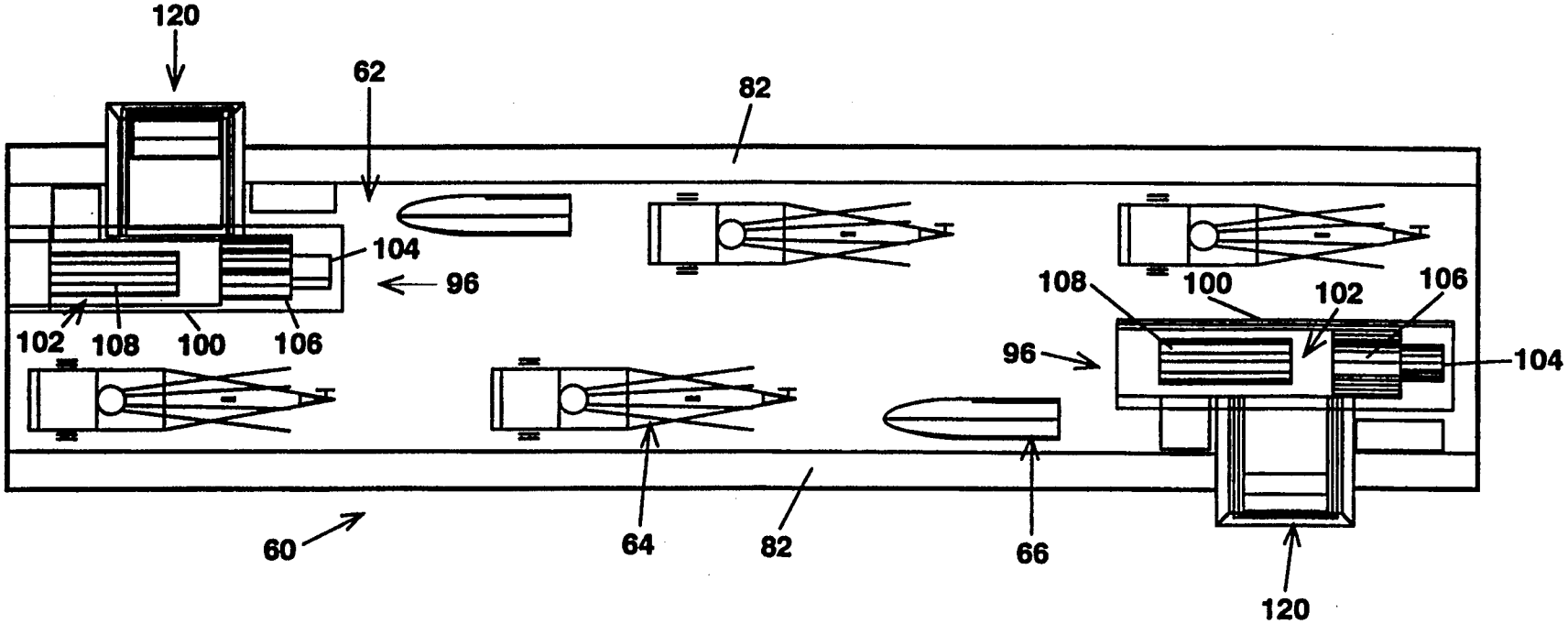
FIG. 9. is a top view of a deckhouse showing deckhouse mounted power modules.

Examples 1–5 demonstrate the practical limits of beneficial results obtainable through introducing modified propulsion and ship-service machinery options into standard prior art monohull designs. The modifications employ existing machinery, arranged in the traditional manner in conventional monohulls, i.e., hulls having vertical topsides 10, transom sterns 11, conventional powerplants 12 located in the center of the hulls, and long shafts 14 connecting powerplants 12 and propellers 30 (see FIGS. 1–4). As shown in FIGS. 3 and 4, all main propulsion machinery 22 and ship-service machinery 26, with the exception of a standby ship-service gas turbine driven generator 28 located near the stern, are in the machinery box (a series of machinery rooms located near the midships). Main machinery rooms 16 (MMRs) are separated by three bulkheads. Large vertical trunks , containing intake ducts 18 and exhaust ducts 20, run from the top of the MMRs up through the hull and deckhouse. Gears and/or motors are placed low to minimize shaft angles. Shafts 14 run from the MMRs to strut supported port and starboard propellers 30.

Example 1

Referring to FIGS. 1–4, Example 1 presents a reference destroyer (hereinafter referred to as REFDD) representing a prior art naval combatant configuration designed using present Navy design methodology. Lightship displacement (zero-fuel-load, no payload) is 5887 long ton (LT), while full-load displacement is 8174 LT. REFDD carries 1734 LT of usable fuel. Ship beam at both the design waterline and weather deck is 55.5 ft (vertical topsides). Prismatic coefficient (CP) is 0.576 and maximum section coefficient (CX) is 0.836. REFDD is a conventional, mechanically driven, open-shaft-and-strut destroyer with four General Electric LM2500 simple cycle gas turbine propulsion engines 22 (rated at 20,421 horsepower each) driving two controllable-reversible-pitch propellers 30 (two engines per shaft) through a pair of locked train double reduction gears 24 acting as mechanical transmissions. The reduction gear are located as low as possible in the hull to provide a maximum shaft angle of 3.5°. Separate ship-service power generation machinery 26 and 28 are provided by three Allison 501K17 gas turbines (rated at 2000 kilowatts each) each geared to a two-pole 60 Hz alternator (i.e., three ship-service turbine-generator sets). All the propulsion and ship-service engine-generator sets are mounted on steel bedplates having steel pedestals running down to the hull's bottom structure. Steering is provided by two spade rudders 22 mounted aft of the propellers. REFDD is designed, as are all present naval combatants, for stability at full-load. Metracentric height is 4.17 feet. Consequently, REFDD requires seawater ballast to replace fuel in the fuel tanks in order to retain stability and roll frequency throughout the mission.

Example 2

Example 2 introduces propulsion derived ship-service power to the ship of Example 1. Two of the ship-service turbine-generator sets are replaced by 12-pole, variable-speed, constant-frequency (VSCF) liquid cooled alternators connected to the high-speed side of the reduction gear (alternators may alternatively be driven directly by the propulsion turbines). Since engine speed varies, cycloconverters are added to provide high quality 60 Hz power regardless of alternator speed. Thus, ship-service power is generated by an already operating gas turbine with lower specific fuel consumption than the 501K17 turbines. The overall consequence is the elimination of two 501K17 engines, a 12 percent reduction in required endurance fuel, and a 4% reduction in both required turbine power and machinery weight. A portion of the fuel must still be compensated for by addition of seawater into the fuel tanks, however, much of the ballast water can be introduced into clean tanks.

Example 3

The simple-cycle LM2500 gas turbine propulsion engines of Example 2 are directly replaced by intercooled, recuperated (ICR) gas turbines propulsion engines. The propulsion-derived ship-service power system remains driven by the propulsion engines. Although, due to the heat exchangers, the ICR engines are heavier, they require less airflow and, consequently, reduced ducting. The improved efficiency of the ICR engines results in a 28% reduction in fuel consumption (and, thus, in required fuel load) and a 4% reduction in required turbine power. Space is freed up to provide sufficient clean water ballast tanks to keep the ship at constant stability throughout the mission using clean seawater. ICR gas turbines also have reduced exhaust gas temperatures and, thus, reduced infrared detectability.

Example 4

A direct-drive, solid state-controlled air-cooled AC electric motor transmission replaces each locked-train double reduction gear of Example 3. Since the motor can be reversed, fixed-pitch propellers with small shafting and struts may replace heavier controllable-reversible-pitch propellers and their larger shafts and struts. Since electrical cross-connection between the two shafts is now possible, three heavily loaded propulsion engines (each rated at 26,048 hp) diving air-cooled alternators replace the four lighter loaded propulsion engines of Example 3. The propulsion-derived ship-service power system remains driven by the propulsion engines. However, the VSCF system rating is increased to 4000 kW each so that a single engine may provide all propulsion and ship-service power during cruise operating conditions (up to 25 knot cruise speed). A 28 ton battery energy storage system permits operation on one turbine for cruise, while providing interim ship-service power between failure of the operating turbogenerator and startup of a replacement. This system employs ordinary lead acid batteries and large inverters that are distributed appropriately throughout ship. The result is a 15% reduction in fuel consumption and a 2% reduction in required turbine power. However machinery weight increases because of the large specific weight required by electric machinery with low rotor tip speeds.

On an electric drive ship, as presented in this and the remaining examples, a first winding on the armature of the propulsion turbine provides propulsion power. A second high-voltage winding on the armature of the existing propulsion turbine may be added to provide high-voltage power for high energy weapon systems.

Example 5

Example 5 presents the last conventionally configured, open shaft and strut vessel. The large diameter, low speed direct drive electric motors and fixed-pitch propellers and shafting of Example 4 are replaced by small diameter, high speed electric motors and ring-ring, bicoupled, CR epicyclic reduction gears driving CR propellers, with accompanying CR shafting, seals, and thrust bearings. Increased efficiencies of the CR propellers and the high-speed motors results in a 15% reduction in required power, a 10 percent reduction in fuel consumption, a 9% reduction in machinery weight, and a 6% reduction in both lightship and full-load displacement.

The overall improvements attributable to the subsystems and components of Example 5 over REFDD of Example 1 include 52% reduction in fuel consumption and 25% reduction in required power at sustained speed. Furthermore, although machinery weight and lightship weight are reduced by 5% and 4%, respectively, due to the reduced fuel load requirements, full-load displacement is reduced by 14%.

Examples 1–5 presented modified machinery options installed in conventionally configured displacement monohulls. While variants on the machinery types involved here could be introduced, the overall improvement in ship efficiency does not change substantially until a new and innovative approach is taken. Thus, the present invention introduces the subsystems and components of Example 5 into a ship having radically different hull and machinery configurations.

Preferred embodiments of the present invention are presented in Examples 6–10. The machinery of Example 5 is reconfigured into modular packages installed outside the watertight confines of a new tumble home hull with integrated superstructure (deckhouse and steeple with identical tumble home of lower hull). The machinery modules are removable and, thus, do not require drydocking for repair or replacement. In addition, the machinery modules require little shafting (propulsion driveline is located completely outside the watertight hull) or ducting (vertical intake ducting and side exhaust ducting are located close to engines that are mounted outside the watertight hull). Thus, weight required for both shafting and ducting are drastically reduced, while corresponding system efficiency is increased. Moreover, reduced volume requirements of the shafting and ducting permit the unconventional tumble home hull configuration. Machinery and fuel weight savings and reduced draft allow further installed power reduction, uniform lower deck heights, and improved seakeeping. A further characteristic of the new hull is its clean, uncluttered configuration having no right-angled intersections and few protuberances thus providing minimum radar scattering back toward either a surface ship, a sea-skimming missile, or a satellite.

EXAMPLE 6

Example 6 presents a modular ship configuration with a tumble home watertight hull having no major machinery therein. Tumble home angle is constant at 10°. A composite material steeple 68 of quadrilateral cross-section atop the deckhouse 60 contains the radar and radio communication systems in a vertical coaxial configuration. Prismatic coefficient (CP) is 0.578 and maximum section coefficient (CX) is 0.830.

One ICR gas turbines propulsion engine and its associated propulsion alternator are removed. All other main machinery is retained, i.e., two ICR gas turbines 102 (each rated at 25580 hp) and associated propulsion alternators 106 (AC liquid cooled propulsion generators rated at 28 mW each), two propulsion derived ship-service power alternators 104 (4000 kW each), and one separate ship-service turbine generator set (3000 kW). All are mounted on weather deck 48 in helicopter hanger 62 located within deckhouse 60. A propulsion alternator 106 and a propulsion derived ship-service power alternator 104, driven by ICR gas turbine 102, are mounted on the shaft of each gas turbine 102 to form two power modules 100. The power modules are fixed to composite material bedplates mounted directly to the deck. The elimination of steel bedplates and pedestals reduces foundation weight by approximately two-thirds. Each power module 100 has short vertical inlet ducting 118, mounted directly above the power module air intake, with inlets 116 built into the top of the helicopter hanger and having side or aft facing inlet louvers 117. Exhaust ducts 122 may be either through the top of the hangar or, preferably, side mounted to exhaust downward over the side of the tumble home hull.

Propellers 184, propeller shafts with associated seals and bearings 186, CR gears 192, and geared AC liquid-cooled electric propulsion motors 190 (rated at 27.2 mW) are built into capsules 138 that are fitted into two steerable pods 136, which are part of stern mounted removable propulsor modules 98. Each capsule 138 is inserted into open forward end 180 of streamlined cylindrical steerable pod 136, with one acoustically compliant mounting point forward and one aft. Contrarotating tractor propellers 184 face directly into the flow stream. The use of electric drive allows propulsor modules 98 and power modules 100 to be independently located. Consequently, the pod mounted AC motors are connected to the AC propulsion generators of the main power modules by electrical lines only and, thus, the long drive shafts of the previous examples are eliminated. Synchronous AC electric drive, with identical high-speed, four-pole alternators (located in power modules 100) and motors (located in propulsor modules 98), provides reasonable efficiency with great simplicity and low cost. No solid state control is used, thereby minimizing cost, size, weight, acoustic signature, and power losses. An increased reduction ratio for low speed operation is available by switching the motor windings to provide a large number of virtual poles. Pole-switching of the motors provides eight virtual poles for operation at 6 to 19 knots speed, and damper shields provide induction-motor torque for startup and low speed reversing. Furthermore, since the steerable pods provide steering control, the two stern mounted spade rudders are eliminated.

All machinery in each power module and propulsor module is pre-aligned and pre-tested prior to installation, thus, reducing expensive and time consuming in situ alignment. All modules are installed after construction of the watertight hull has been completed and are pierside installable and replaceable.

The reduced resistance of steerable pods compared to open shaft and strut mounted propellers and stern mounted rudders, and the reduction in weight of the propeller shafting and inlet and exhaust ducts, provide synergistic improvements over conventionally configured hulls. Required power decreases 23%, machinery weight 29%, fuel weight 12%, lightship displacement 19%, full-load displacement 17% and ducting and shafting weight 81% from the ship of Example 5. Moreover, maneuverability and stealth increase enormously.

Example 7

The separate ship-service turbine generator set of Example 6 provides a redundant ship-service capability and is thus eliminated. Ship displacement, fuel load, and required power are reduced accordingly. The expanded area of the 17 ft diameter propellers may also be reduced. By reducing the expanded area ratio from 1.0 to 0.8, incipient cavitation speed is decreased from 28.6 knots to 25.2 knots (compare this to REFDD which cavitates at all speed above endurance speed), however, required power is reduced by 3% and fuel consumption by 2%.

Example 8

As stated earlier, wave resistance increases dramatically with increasing Froude Number. Furthermore, at low speeds, wave resistance does not decrease to zero because the submerged transom produces waves (low speed wave resistance is the price paid by transom stern vessels for reducing wavemaking at high speeds). Increasing effective ship length decreases Froude Number and volumetric coefficient with a resulting decrease in high speed resistance.

A retractable variable angle stern flap 194 is pivotally mounted to propulsor modules 98 of Example 7. The length of the stern flap is preferably equal to the height of the transom. Thus, ship length can be maximized when the flap is deployed without increasing air resistance when the flap is rotating up against the transom for stowing. In this case, the flap is 24 feet in length (equal to the transom height) increasing effective length when deployed to 553 feet. By deploying the stern flap at high speed, effective ship length is increased and resistance decreased. Furthermore, the stern flap offers the opportunity to provide the best effective transom submergence and ship trim at all speeds.

Example 9

The stern flap equipped ship of Example 8 has a very small fuel load and, thus, excess fuel capacity. By adding another 787 tons of fuel, ship range can be doubled to 12,000 nmi while maintaining the same horsepower as the 6000 nmi range no-flap ship. However, with this configuration, there is not enough space for the clean ballast tankage required to permit completely clean ballast to compensate for all fuel burned.

Example 10

Example 10 presents an alternative preferred embodiment of the present invention. The tumble home hull has a constant tumble home angle of 12°. Prismatic coefficient (CP) is 0.576 and maximum section coefficient (CX) is 0.784. The ship retains the machinery options of Example 9, with the length increased to 553 feet (length of the previous ship with flap deployed) and thus has no flap. The ship is designed for adequate transverse stability with zero-fuel and has a metracentric height of 4.6 ft with no fuel aboard. Thus, no seawater ballast is required to maintain stability throughout the mission. When fuel for 12,000 nmi endurance range is added the metracentric height increases by only 10% to 5.06 ft due to the tumble home hull. Consequently, the roll frequency increases by less than 5%, resulting in negligible change in ride comfort.

Composite material steeple 68 is coupled to deckhouse 60 and supports vertically coaxial (and, therefore, non-interfering) radar and communication antenna 70 in an enclosed environment thereby minimizing maintenance. Each level of the steeple is selectively shielded with narrow band-pass aluminized mylar sheets on the inner surface of the steeple. This material passes specific radar or radio frequencies with little attenuation, while reflecting enemy radar. Additionally, individual waveguides and antenna leads in the corners of the steeple closely couple the antenna to the transmitters powering them, while minimally affecting the transmission and reception of other coaxially mounted antenna.

Watertight hull 40, which includes the lower tumble home hull and integral deckhouse 60, is designed with a continuous steel structure. As illustrated in FIGS. 11 and 12, main structural members includes two longitudinally continuous box girders 82 extending upward into the deckhouse 60 and a longitudinally continuous centerline keel 84. Additional strength members include the outer shell plating 86 (lower hull and deckhouse) and inner hull sides 88 and bottom 90. This structural configuration provides longitudinal continuity of load carrying and is effective in resisting hull bending stresses due to waves of critical length (equal to one ship length) in both hogging (waves high amidships) and sagging (waves high forward and aft) conditions. Furthermore, the continuity of the girders provides continuous, unobstructed passageways for cables and piping and will simplify hull assembly and ease the difficulty of identifying and isolating cable and piping faults.

The foregoing series of design innovations results in the present invention, a unique ship design where all main machinery is modular and is located outside a watertight tumble home hull. All engines are located in the deckhouse, preferably in the helicopter hanger (or alternatively above the aft mounted propulsor modules, or one in the deckhouse and one above the propulsor module to prevent damage to both in the event of an explosion). The propulsion driveline is housed outside the watertight hull in steerable pods.

As compared to the reference destroyer (REFDD), the present invention is slender with a 10% increase in length-to-beam ratio. The ship carries the same armament suite but has a lightship displacement of under 4600 long tons, a 22% reduction in lightship displacement, with associated reduction in material costs. Ship volume is decreased by 20%. The required power, and thus the required powerplant and fuel expended, are the major expenses associated with initial and operational costs of the ship. The present invention reduces required power at sustained speed by 42%, with associated reduction in costs. With intercooled, recuperated engines it has enough tankage to double the conventional range. The tumble home hull permits relatively uniform static stability from full-load to fuel burn out, thus, no sea water ballast is required. The synergistic benefits resulting from the present invention's combination of a novel machinery configuration with a non-conventional hull configuration include reduced power requirements, fuel consumption and cost, increased range, superior stealth, superior seakeeping, reduced environmental impact, reduction in the number of gas turbines from seven to two, increased payload capacity per ton of ship displacement, and a more friendly environment for personnel.

The advantages of the present invention are numerous. The present invention provides a new ship configuration having simplified construction, efficient use of midship space for personnel and operations, easy access to or removal of main machinery allowing major maintenance without drydocking, and lower initial, operating, and maintenance costs. Compared to current Naval combatants, the present invention provides a ship design of greater simplicity, increased range, greater stealth, increased payload capacity while maintaining reduced lightship displacement, superior seakeeping with no seawater ballast and thus reduced pollution, sharper turns when going either ahead or astern, shorter distance stops, and the same continuous and endurance speeds with reduced installed power and fuel consumption. In the preferred embodiment, two intercooled, recuperated gas turbines replace seven simple-cycle gas turbines, and deliver the same speed at less than half the installed power and fuel consumption, and produce far less pollution. The ship requires lower manning and fewer auxiliary ships for refueling. Additionally, preassembled, prealigned and pretested machinery saves the enormous cost of aligning machinery in the ship.

These advantages resulted from a synergistic combination of hull, mechanical, and electrical system design modifications that simultaneously improved simplicity, efficiency, signatures, maneuverability and seakeeping, weight, and cost. Synergistic design modifications include adopting a tumble home hull with podded propulsor configuration having geared electric drive and CR propellers, removal of the major machinery from the hull midships to a point outside the watertight hull, and making the deckhouse a continuation of the box girders. The consequences include simplified propulsion and electrical systems, short shafting and short ducting that reduce weight and resistance, steerable pods having resistance much lower than open shafting and rudders, and acoustic, radar, and infrared signatures that almost automatically improve.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. The forms of the present invention herein described are not intended to be limiting but are merely preferred or exemplary embodiments thereof.

What is claimed is:

1. A vessel with machinery modules outside a watertight hull, comprising:

a watertight hull having a stem bow and a tumble home configuration comprising a longitudinally extending hull bottom, port and starboard inward-sloped topsides extending upward from said hull bottom, a longitudinally extending weather deck, and a substantially vertical aft end;

a deckhouse structurally integral with said watertight hull, said deckhouse located above said weather deck at a substantially centrally located portion of said vessel; and a plurality of pretested, prealigned propulsion modules mounted outside of said watertight hull, wherein said propulsion modules are installable after construction of said watertight hull and further wherein said propulsion modules are removable and replaceable without drydocking, said propulsion modules comprising:

at least one steerable propulsor module attached to said aft end of said watertight hull, and at least one power module, each of said power modules in electrical communication with one of said propulsor modules, each of said power modules including therein power production means for providing ship-service power to said vessel and propulsion and steering power to said propulsor module.

2. A vessel as in claim 1 further comprising a composite material steeple attached to said deckhouse, said steeple containing rotating and stationary antennas in coaxial alignment therein and wherein said inward-sloped topsides have a constant inward-slope angle of between about 10° and about 12° to vertical.

3. A vessel as in claim 1 wherein each of said at least one steerable propulsor modules comprises:

an outer housing having inward-sloped topsides, said outer housing secured to said aft end of said watertight hull and defining a vessel stern;

a substantially vertically aligned rotatable barrel mounted within said outer housing and containing steering means therein, said steering means operative to rotate said rotatable barrel relative to said outer housing;

an axisymmetric pod having an open forward end and a pointed aft end, said pod having mounted therein a prealigned, pretested integrated machinery capsule, wherein said integrated machinery capsule contains at least one rotatably mounted propeller shaft that extends forward of said pod open forward end, shaft seals, thrust bearings, at least one propeller mounted to a forward end of said at least one propeller shaft, and power means functioning to rotate said at least one propeller; and a streamlined strut rigidly connected at a top end to said rotatable barrel and rigidly connected at a bottom end to said pod.

4. A vessel as in claim 3 wherein said steering means includes a geared electric motor and dynamically balanced, high-reduction-ratio dual orbital gears.

5. A vessel as in claim 3 wherein said at least one propeller comprises contrarotating propellers, said at least one propeller shaft comprises contrarotating propeller shafts, and said power means comprise a liquid cooled alternating-current electric motor and a contra-rotating reduction gear.

6. A vessel as in claim 5 wherein said contrarotating reduction gear comprises a ring-ring bicoupled contra-rotating epicyclic reduction gear.

7. A vessel as in claim 3 wherein said outer housing defines a transom stern and further wherein a retractable variable angle stern flaps is pivotally mounted to said outer housing at said transom stern.

8. A vessel as in claim 1 wherein said at least one power module is mounted within said deckhouse and further wherein said power production means comprise:

a gas turbine;

a ship-service generator powered by said gas turbine and functioning to provide ship-service electric power to said vessel; and a propulsion generator powered by said gas turbine, said propulsion generator operatively connected with said propulsor module to provide electric power to said propulsor module.

9. A vessel as in claim 8 wherein said gas turbine comprises an intercooled, recuperative gas turbine, said gas turbine including an intercooler integral with said gas turbine, and a recuperator integral with said gas turbine.

10. A vessel as in claim 1 wherein said at least one power module is mounted atop said at least one propulsor modules and further wherein said power production means comprise:

a gas turbine;

a ship-service generator powered by said gas turbine and functioning to provide ship-service power to said vessel; and a propulsion generator powered by said gas turbine, said propulsion generator operatively connected with said propulsor module to provide electric power to said propulsor module.

11. A vessel as in claim 10 wherein said gas turbine comprises an intercooled, recuperative gas turbine, said gas turbine including an intercooler integral with said gas turbine, and a recuperator integral with said gas turbine.

12. A vessel as in claim 1 wherein said at least one power module includes first and second power modules, wherein said first power module is mounted within said deckhouse and said second power module is mounted atop one of said at least one propulsor modules, and further wherein said power production means comprise:

a gas turbine;

a ship-service generator powered by said gas turbine and functioning to provide ship-service power to said vessel; and a propulsion generator powered by said gas turbine, said propulsion generator operatively connected with said propulsor module to provide electric power to said propulsor module.

13. A vessel as in claim 12 wherein said gas turbine comprises an intercooled, recuperative gas turbine, said gas turbine including an intercooler integral with said gas turbine, and a recuperator integral with said gas turbine.

14. A vessel as in claim 1 further comprising a battery energy storage system for providing ship-service power in the event said ship-service generator fails or is taken off line.

15. A vessel as in claim 1 further comprising at least one short over-the-side exhaust duct, each of said at least one short over-the-side exhaust duct located adjacent to one of said at least one power module and in flow communication with an exhaust of one of said at least one power module, and each of said at least one short over-the-side exhaust duct including a boundary-layer induction signature suppressor and a radar reflecting exhaust cap.

16. A vessel as in claim 1 further comprising:

primary structural members including two longitudinally continuous box girders and a longitudinally continuous keel, said box girders and keel extending substantially from said bow to said aft end of said watertight hull, said box girders defining an intersection of said inward-sloped topsides and said weather deck, a portion of said box girder adjacent said deckhouse extending upward from said weather deck substantially to a top of said deckhouse and defining longitudinally extending inward-sloped sides of said deckhouse.

17. A vessel as in claim 1 wherein said watertight hull is separated longitudinally into a plurality of survivable watertight compartments, each of said compartments having at least one auxiliary machinery module mounted therein, said at least one auxiliary machinery module including heating means, air conditioning means, ventilation means, fire suppression means, and backup electric power means.

18. A vessel as in claim 17 further comprising:

primary structural members comprising two longitudinally continuous box girders and a longitudinally continuous keel, said box girders and keel extending substantially from said bow to said aft end of said watertight hull, said box girders defining an intersection of said inward-sloped topsides and said weather deck and extending from said weather deck downward one deck, a portion of said box girder adjacent said deckhouse extending upward from said weather deck substantially to a top of said deckhouse and defining longitudinally extending inward-sloped sides of said deckhouse, said box girders contain a plurality of longitudinally extending cables and pipes therein;

a plurality of watertight insulated electrical connector plugs penetrating a wall of at least one of said box girders, at least one of said plugs located adjacent each of said compartments, each of said plugs being in electrical communication with at least one of said longitudinally extending cables and further being in electrical communication with at least one cable in one of said compartments; and a plurality of transverse pipes penetrating a wall of at least one of said box girders, at least one of said pipes located adjacent each of said compartments, each of said transverse pipes including a sealing means thereon operative to create a watertight seal between said transverse pipe and said box girder, each of said transverse pipes being in flow communication with at least one of said longitudinal pipes and further being in flow communication with at least one pipe in one of said compartments, each of said transverse pipes including a shut-off valve on each side of said wall of said box girder.

19. A vessel as in claim 1 further comprising flared topsides below said weather deck and flared bulwarks above said weather deck, said flared topsides and bulwarks extending aft from said stem bow.

20. A vessel as in claim 3 wherein said streamlined strut includes port and starboard ejection ports and a circulation control valve for preferentially ejecting water through said ejection ports to provide steering control by way of circulation control through the Coanda effect.

21. A high speed naval combatant, comprising:

a watertight hull having a stem bow and a tumble home configuration comprising a longitudinally extending hull bottom, port and starboard inward-sloped topsides, a longitudinally extending weather deck, and a substantially vertical aft end, said watertight hull separated longitudinally into a plurality of survivable watertight compartments, each of said compartments having at least one auxiliary machinery module mounted therein, said at least one auxiliary machinery module including heating means, air conditioning means, ventilation means, fire suppression means, and backup electric power means;

a deckhouse structurally integral with said watertight hull, said deckhouse located above said weather deck at a substantially centrally located portion of said vessel, said deckhouse including a helicopter hanger;

a composite material steeple attached to said deckhouse, said steeple containing rotating and stationary antennas in coaxial alignment therein, each of said antenna transmitting within a narrow frequency range, inside walls of said composite material steeple having radar-reflective materials thereon, said materials operative to reflect radar originating from without said vessel but allowing a narrow-band transmission from said antennas; and a plurality of pretested, prealigned propulsion modules mounted to an outer surface of said watertight hull, wherein said propulsion modules are installable after construction of said watertight hull and further wherein said propulsion modules are removable and replaceable without drydocking, said propulsion modules comprising:

at least one steerable propulsor module attached to said aft end of said watertight hull, said at least one steerable propulsor module including:

an outer housing secured to said aft end of said watertight hull and defining a vessel stern, a substantially vertical rotatable barrel mounted within said outer housing and containing steering means therein, said steering means including a geared electric motor and dynamically balanced, high-reduction-ratio dual orbital gears functioning to rotate said rotatable barrel relative to said outer housing, an axisymmetric pod having an open forward end and a pointed aft end, said pod having mounted therein a prealigned, pretested integrated machinery capsule, said integrated machinery capsule containing contrarotating propeller shafts that extend forward of said pod open forward end, shaft seals, thrust bearings, contrarotating propellers mounted on a forward end of said contrarotating propeller shafts, a liquid cooled alternating-current electric motor and a contrarotating reduction gear functioning to rotate said contrarotating propellers, and a streamlined strut rigidly connected at a top end to said rotatable barrel and rigidly connected at a bottom end to said pod, wherein said streamlined strut includes port and starboard ejection ports and a circulation control valve for preferentially ejecting water through said ejection ports to provide steering control by way of circulation control through the Coanda effect; and at least one power module mounted within said helicopter hanger, each power module including:

an intercooled, recuperative engine including a gas turbine, an intercooler integral with said gas turbine, and a recuperator integral with said gas turbine, a ship-service generator powered by said engine and functioning to provide ship-service electric power to said naval combatant, and a propulsion generator having a first winding powered by said engine and operatively connected with said propulsor module to provide electric power to said propulsor module, and a second, coaxial high voltage winding capable of powering high energy weapon systems.

22. A naval combatant as in claim 21 wherein said inward-sloped topsides have a constant inward-slope angle of between about 10° and about 12°, and wherein said naval combatant further includes flared topsides below said weather deck and flared bulwarks above said weather deck, said flared topsides and bulwarks extending aft from said stem bow.

23. A high speed naval combatant as in claim 22 further comprising:

primary structural members comprising two longitudinally continuous box girders and a longitudinally continuous keel, and strength members comprising outer shell plating, and inner hull sides and bottom, said box girders and keel extending substantially from said bow to said aft end of said watertight hull, said box girders define an intersection of said inward-sloped topsides and said weather deck and extending from said weather deck downward one deck, a portion of said box girder adjacent said deckhouse extending upward from said weather deck substantially to a top of said deckhouse and defining longitudinally extending inward-sloped sides of said deckhouse, said box girders contain a plurality of longitudinally extending cables and pipes therein, at least one of said box girders contains longitudinal walkways functioning to provide personnel access among said plurality of survivable compartments;

a plurality of watertight insulated electrical plug connectors penetrating a wall of each box girder, at least one of said plugs located adjacent each of said compartments, each of said plugs being in electrical communication with at least one of said longitudinally extending cables and further being in electrical communication with at least one cable in one of said compartments; and a plurality of transverse pipes penetrating a wall of each box girder, at least one of said transverse pipes located adjacent each of said compartments, each of said transverse pipes including a sealing means thereon operative to create a watertight seal between said transverse pipe and said box girder, each of said transverse pipe being in flow communication with at least one longitudinal pipe and further being in flow communication with at least one pipe in one of said compartments, each of said transverse pipe including a shut-off valve on each side of said wall of said box girder.

* * * * *